US010673181B2

(12) United States Patent
Horii

(10) Patent No.: US 10,673,181 B2
(45) Date of Patent: Jun. 2, 2020

(54) ELECTRICAL CONNECTOR FOR CIRCUIT BOARDS

(71) Applicant: Hirose Electric Co., Ltd., Shinagawa-ku, Tokyo (JP)

(72) Inventor: Takao Horii, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/393,818

(22) Filed: Apr. 24, 2019

(65) Prior Publication Data

US 2019/0334288 A1 Oct. 31, 2019

(30) Foreign Application Priority Data

Apr. 26, 2018 (JP) ..... 2018-085147

(51) Int. Cl.

| | |
|---|---|
| ***H01R 13/24*** | (2006.01) |
| ***H01R 13/631*** | (2006.01) |
| ***H01R 13/422*** | (2006.01) |
| ***H01R 12/72*** | (2011.01) |

(52) U.S. Cl.

CPC ..... *H01R 13/6315* (2013.01); *H01R 12/727* (2013.01); *H01R 13/24* (2013.01); *H01R 13/422* (2013.01)

(58) Field of Classification Search

CPC . H01R 12/727; H01R 12/716; H01R 13/6315
See application file for complete search history.

(56) References Cited

U.S. PATENT DOCUMENTS

| | | | | |
|---|---|---|---|---|
| 9,048,601 | B2 * | 6/2015 | Kimura | H01R 24/60 |
| 9,252,517 | B2 * | 2/2016 | Kimura | H01R 12/85 |
| 9,331,414 | B2 * | 5/2016 | Doi | H01R 12/65 |
| 9,711,880 | B2 * | 7/2017 | Kiryu | H01R 12/716 |
| 9,887,484 | B1 * | 2/2018 | Hu | H01R 13/502 |

FOREIGN PATENT DOCUMENTS

| | | | |
|---|---|---|---|
| JP | 5946804 | B2 | 7/2016 |

* cited by examiner

*Primary Examiner* — Xuong M Chung Trans
(74) *Attorney, Agent, or Firm* — Procopio, Cory, Hargreaves & Savitch LLP

(57) ABSTRACT

An electrical connector for circuit boards whose terminals 40 have stationary-side retained portions 42 retained in place in the stationary housing 20, movable-side retained portions 44 retained in place in the movable housing 30, and resilient portions 45 provided between said stationary-side retained portions 42 and said movable-side retained portions 44, and the resilient portions 45 have curved portions 45A, 45B curved such that they have sections positioned overlappingly in the heightwise direction of the connector perpendicular to the mounting face of the circuit board in a section of the resilient portions 45 in the longitudinal direction of the terminals 40.

4 Claims, 8 Drawing Sheets

(B)

(A)

(A)

(B)

ELECTRICAL CONNECTOR FOR CIRCUIT BOARDS

CROSS-REFERENCE TO RELATED APPLICATIONS

This application claims priority to Japanese Patent Application No. 2018-085147, filed Apr. 26, 2018, the contents of which are incorporated herein by reference.

BACKGROUND

Technical Field

The present invention relates to an electrical connector for circuit boards disposed on a mounting face of a circuit board.

Related Art

Known connectors for circuit boards include, for example, the connector of Patent Document 1. The connector of Patent Document 1 is a so-called floating connector, to which a counterpart connector is matedly connected in a vertical direction perpendicular to a mounting face of a circuit board while misalignment with the counterpart connector in a direction parallel to the above-mentioned mounting face is accommodated by a resilient displacement of terminals. The housing of said connector includes a stationary housing, which is secured to the circuit board by the terminals, and a movable housing, which is formed as a member separate from said stationary housing and is movable relative to said stationary housing. In addition, the terminals are arranged in two rows. Connecting portions intended for connecting to the above-mentioned mounting face are formed at one end of said terminals in the longitudinal direction, and contact portions intended for contacting a counterpart connector element are formed at the other end. Rectilinear resilient portions resiliently displaceable in the connector-width direction are formed in the vertical direction between said connecting portions and said contact portions. The above-mentioned one end of said terminals is retained in place in the above-mentioned stationary housing, and the above-mentioned other end is retained in place in the above-mentioned movable housing.

When the thus-configured connector becomes misaligned with the counterpart connector in the connector-width direction in the process of connector mating or when the connectors are in a mated state, resilient displacement of the resilient portions of the terminals allows the stationary housing, in which the contact portions of said terminals are retained in place, to travel, i.e., float, in the connector-width direction and absorb the above-mentioned misalignment.

To ensure a high degree of floating in such a connector, the total length of the resilient portions of the terminals, in other words, their spring length, needs to be increased. Since the resilient portions of the connector of Patent Document 1 extend in a rectilinear manner in the vertical direction, making the resilient portions longer will cause the connector to become larger in the vertical direction. Thus, in order to reduce the vertical dimensions of said resilient portions while increasing the total length of the resilient portions, it is envisaged that, for example, the resilient portions may have a curved shape by folding them back in the vertical direction. At such time, multiple vertically extending rectilinear sections are formed in the resilient portions, and making the region of overlap of said mutually parallel rectilinear sections larger in the vertical direction correspondingly reduces the profile of the connector.

PATENT DOCUMENTS

[Patent Document 1]
Japanese Patent No. 5946804

SUMMARY

Problems to be Solved

However, if the resilient portions of the terminals are curved as described above, then during floating in the above-mentioned connector-width direction, the resilient portions of the terminals in one of the two rows are resiliently displaced such that they shrink in the connector-width direction, as a result of which the above-mentioned adjacent rectilinear sections move closer together in the connector-width direction. If the connector is used to transmit high-speed signals, there is a risk that cross-talk could occur between said rectilinear sections and the characteristics of high-speed transmission could deteriorate as the above-mentioned rectilinear sections are drawn closer together. Furthermore, the larger the range of overlap of the rectilinear sections in the vertical direction, the greater the degradation of the high-speed transmission characteristics.

In view of these circumstances, it is an object of the present invention to provide an electrical connector for circuit boards capable of ensuring a sufficient degree of floating while reducing the profile of the connector and, moreover, keeping the degradation of the high-speed transmission characteristics to a minimum.

Technical Solution

The electrical connector for circuit boards according to the present invention is provided with terminals, which have a connecting portion intended for connecting to a mounting face of a circuit board formed at one end of said terminals in the longitudinal direction and a contact portion intended for contacting a counterpart connector element formed at the other end thereof, and a housing retaining said multiple terminals in place in array form. Said housing has a stationary housing, which is mounted to a circuit board through the medium of the above-mentioned terminals, and a movable housing, which is formed as a member separate from said stationary housing, is movable relative to said stationary housing, and has the contact portions of the above-mentioned terminals disposed therein.

Such an electrical connector for circuit boards according to the present invention is characterized in that the above-mentioned terminals have stationary-side retained portions retained in place in the stationary housing, movable-side retained portions retained in place in the movable housing, and resilient portions provided between said stationary-side retained portions and said movable-side retained portions, and that the above-mentioned resilient portions have curved portions curved such that they have sections positioned overlappingly in the heightwise direction of the connector perpendicular to the mounting face of the above-mentioned circuit board in a section of said resilient portions in the above-mentioned longitudinal direction.

The resilient portions of the above-mentioned terminals have curved portions and floating is accomplished based on the resilient displacement of said curved portions in the connector-width direction. In the present invention, the curved portions are curved such that they have sections (referred to as "overlapping sections" for ease of discussion) positioned overlappingly in the heightwise direction of the connector. Accordingly, provision of the thus curved portions correspondingly extends the total length of the resilient portions and increases of the degree of floating. In addition, the dimensions of the resilient portions in the heightwise direction of the connector and, consequently, the dimensions of the connector, become smaller, and the profile of the connector is reduced in exact proportion to the extent of overlap of said sections in the heightwise direction of the connector. In addition, in the present invention, the curved portions are formed not throughout the entirety of the resilient portions, but in a certain section of the resilient portions in the longitudinal direction of the terminals. In other words, the extent of the overlapping sections of the curved portions in the heightwise direction of the connector is smaller than when the resilient portions are curved in their entirety. As a result, cross-talk is less likely to occur and the degradation of the high-speed transmission characteristics is minimized.

In the present invention, the above-mentioned curved portions may be formed at least at one end of the above-mentioned resilient portions in the above-mentioned longitudinal direction.

In the present invention, the above-mentioned resilient portions may have regions where sections other than the above-mentioned curved portions overlap with the above-mentioned curved portions in the connector-width direction parallel to the mounting face of the above-mentioned circuit board at an angle to the above-mentioned heightwise direction of the connector. Since shaping the resilient portions in such a manner reduces the dimensions of the resilient portions in the connector-width direction in exact proportion to the above-mentioned regions of overlap, the connector can be made more compact in the connector-width direction.

In the present invention, the above-mentioned multiple terminals have signal terminals and power supply terminals, and the connecting portions of said power supply terminals may be located closer to the contact portions of the above-mentioned signal terminals in the above-mentioned connector-width direction than the connecting portions of the above-mentioned signal terminals. Positioning the connecting portions of the power supply terminals in this manner allows for the connector to be made more compact in the connector-width direction.

Technical Effect

As described above, in the present invention, the resilient portions of the terminals have curved portions, which makes the resilient portions longer in exact proportion to the length of said curved portions and accordingly increases the degree of floating, and, in addition, have sections where the curved portions are positioned overlappingly in the heightwise direction of the connector, which allows for the dimensions of the resilient portions in the heightwise direction of the connector and, consequently, the dimensions of the connector, to be smaller and for the profile of the connector to be reduced. Furthermore, since the curved portions are formed in a section of the resilient portions in the longitudinal direction of the terminals, cross-talk is less likely to occur and the degradation of the high-speed transmission characteristics can be minimized in comparison with making the resilient portions curved in their entirety.

DETAILED DESCRIPTION

An embodiment of the present invention is described below with reference to the accompanying drawings.

Figure 1B:
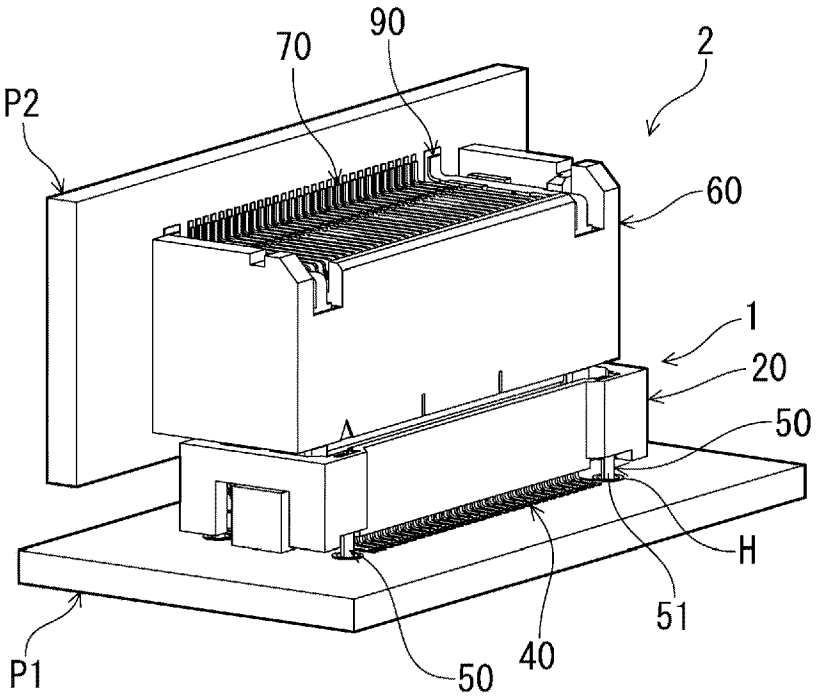
FIGS. 1 (A) and 1 (B) illustrate an external perspective view of a connector assembly according to an embodiment of the present invention including a plug connector and a receptacle connector matedly connected thereto, wherein FIG. 1 (A) illustrates a state before mating and FIG. 1 (B) illustrates a state after mating.
Figure 1A:
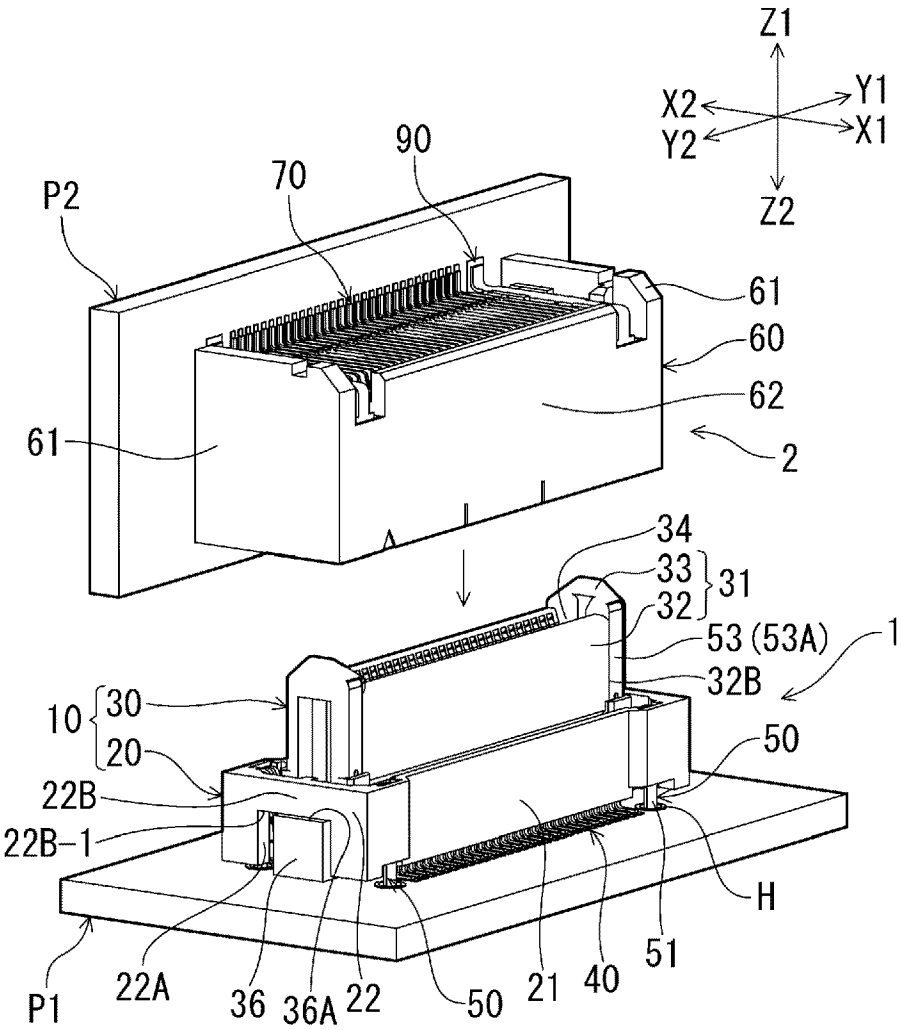
Figures 2A, 2B:
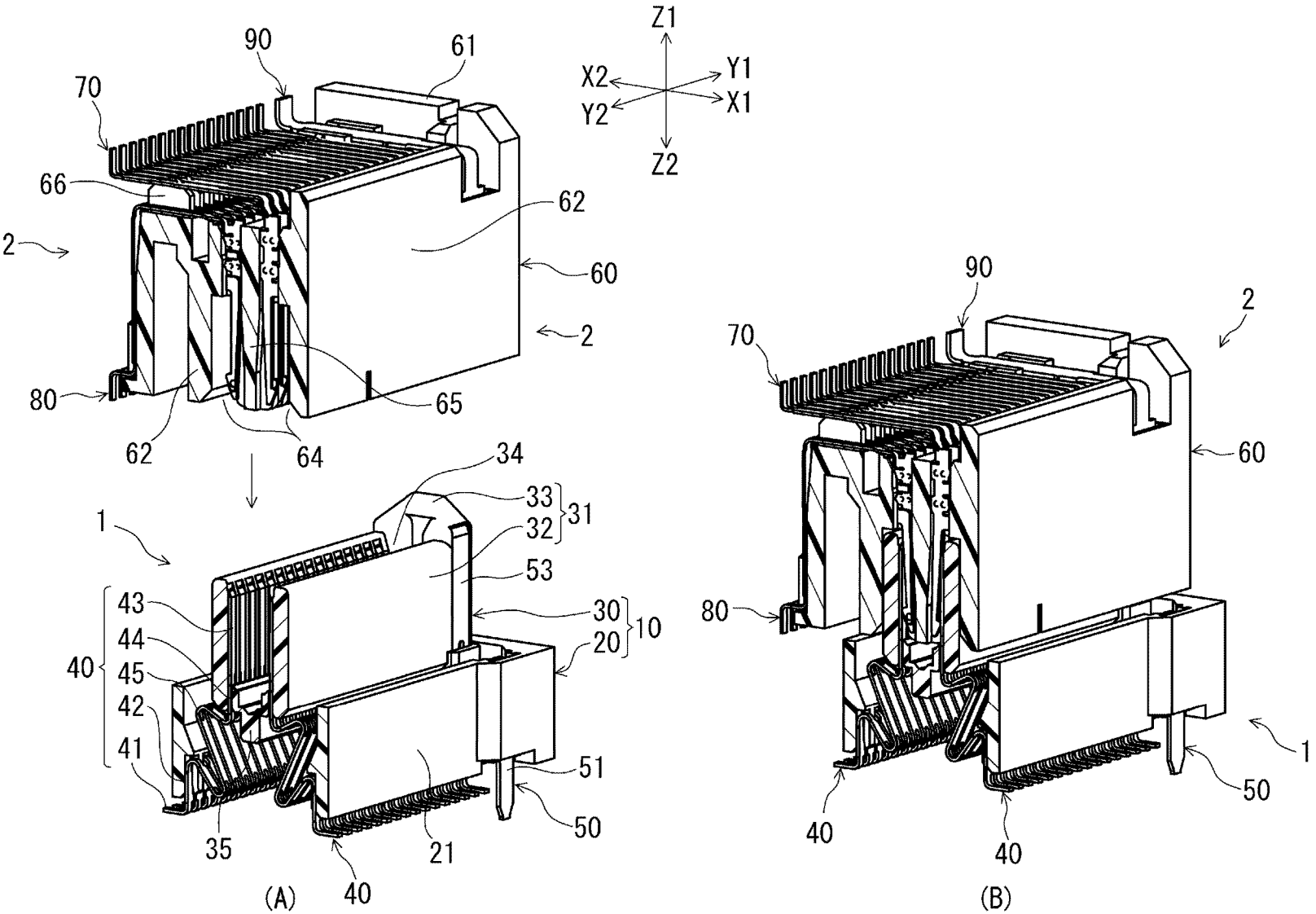
FIGS. 2 (A) and 2 (B) illustrate a perspective cross-sectional view taken at the location of the signal terminals of the two connectors of FIGS. 1 (A) and 1(B), wherein FIG. 2 (A) illustrates a state before mating corresponding to FIG. 1 (A), and FIG. 2 (B) illustrates a state after mating corresponding to FIG. 1 (B).
Figure 3:
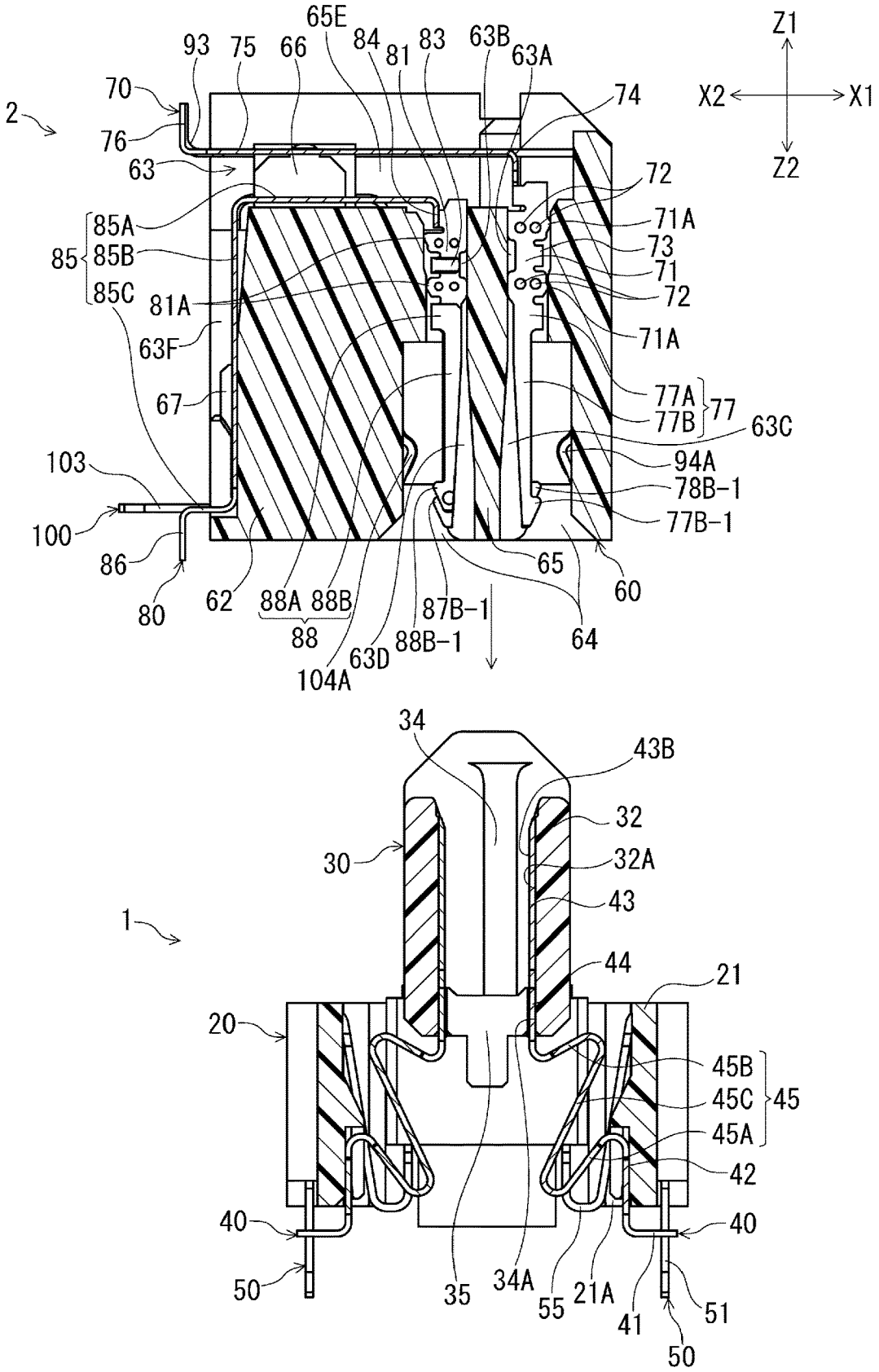
FIG. 3 illustrates a cross-sectional view taken at the location of the signal terminals of the two connectors of FIGS. 1 (A) and 1 (B) and illustrating a state before mating corresponding to FIG. 1 (A).
Figure 4:
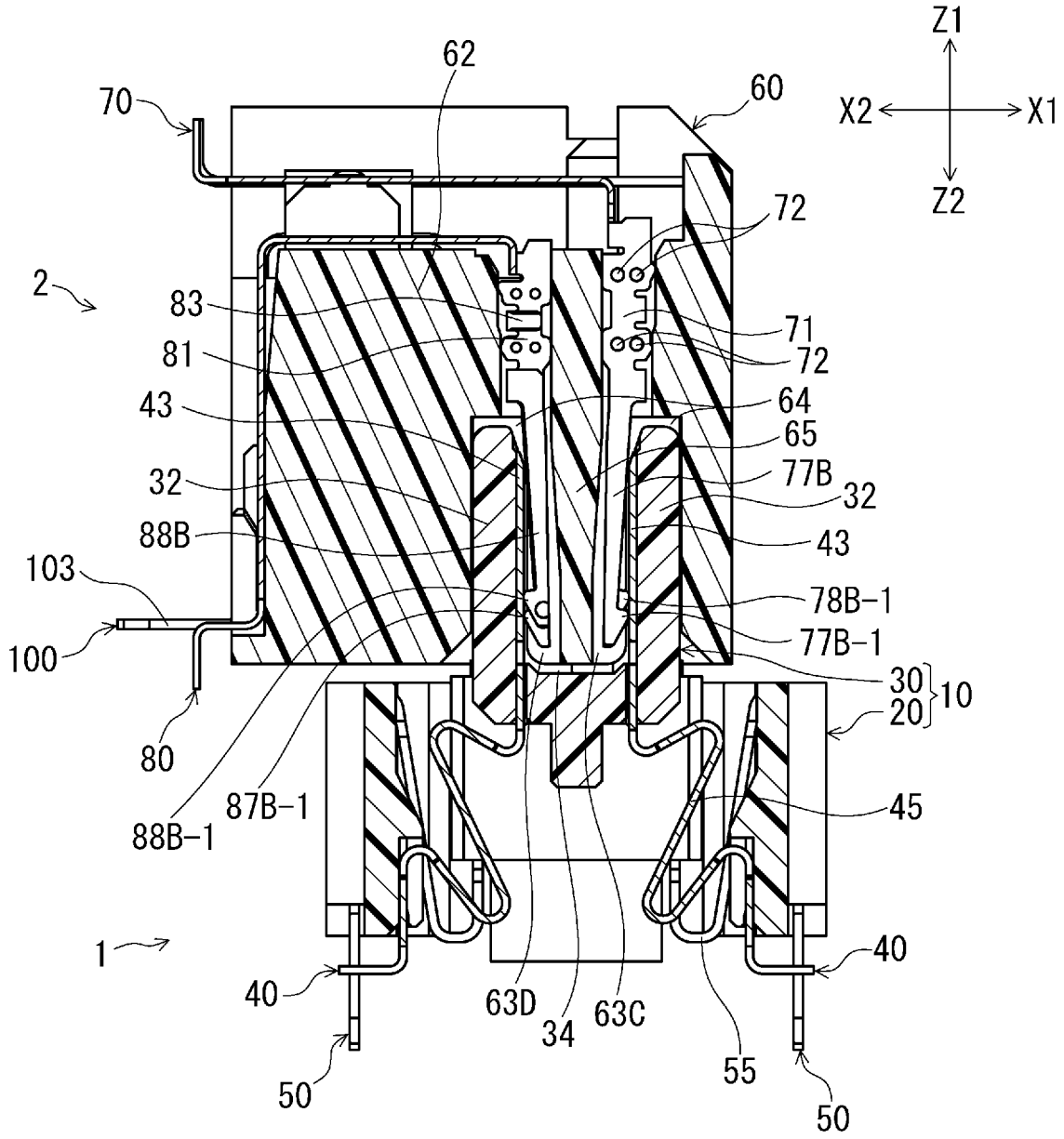
FIG. 4 illustrates a cross-sectional view taken at the location of the signal terminals of the two connectors of FIGS. 1 (A) and 1 (B) and illustrating a state after mating corresponding to FIG. 1 (B).

FIGS. 1 (A) and 1 (B) is an external perspective view of a connector assembly according to an embodiment of the present invention including a plug connector and a receptacle connector matedly connected thereto, wherein FIG. 1 (A) illustrates a state before mating and FIG. 1 (B) illustrates a state after mating. FIGS. 2 (A) and 2 (B) is a perspective cross-sectional view taken at the location of the signal terminals in the direction of the terminal array of the two connectors (plug connector and receptacle connector), wherein FIG. 2 (A) illustrates a state before mating and FIG. 2 (B) illustrates a state after mating in a cross-section perpendicular to the terminal array direction. FIG. 3 and FIG. 4 are cross-sectional views taken at the location of the signal terminals in the terminal array direction of the two connectors, wherein FIG. 3 illustrates a state before mating and FIG. 4 illustrates a state after mating in a cross-section perpendicular to the terminal array direction.

In the present embodiment, the connector assembly is made up of a plug connector 1 and a receptacle connector 2 serving as a counterpart connector (counterpart connector element) matedly connected to said plug connector. The plug connector 1 and the receptacle connector 2 are electrical connectors for circuit boards respectively mounted to different circuit boards.

As can be seen in FIGS. 1 (A) and 1 (B), the plug connector 1 is disposed on the mounting face of a circuit board P1, whose mounting face is perpendicular to the vertical direction (Z-axis direction), and the receptacle connector 2 is disposed on the mounting face of a circuit board P2, whose mounting face is perpendicular to the connector-width direction (X-axis direction). As can be seen in FIGS. 1 (A) and 1 (B), in the two connectors, the mounting faces of the circuit board P1 and the other circuit board P2 are oriented at right angles to each other, as a result of which the connectors are matedly connected such that the vertical direction (Z-axis direction) is the direction of connection. Specifically, as can be seen in FIGS. 1 (A) and 1 (B), the receptacle connector 2 is matedly connected from above the plug connector 1. While in the present embodiment the receptacle connector 2 is assumed to be the counterpart connector (counterpart connector element) of the plug connector 1, it goes without saying that the plug connector 1 can be viewed as a counterpart connector (counterpart connector element) from the standpoint of the receptacle connector 2.

The plug connector 1, whose vertical direction (Z-axis direction) is the heightwise direction of the connector, has a plug housing 10 extending in a single longitudinal direction (Y-axis direction) parallel to the mounting face of the circuit board P1, as well as plug signal terminals 40 and plug power supply terminals 50 (referred to as "plug terminals 40, 50" for brevity below when there is no need to distinguish the two), which are retained in place in array form in the plug housing 10 such that said longitudinal direction is the terminal array direction. Multiple plug signal terminals 40 are arranged in the intermediate area of the plug housing 10 in the terminal array direction (Y-axis direction), and the plug power supply terminals 50 are provided on both sides of the array range of the plug signal terminals 40 in the terminal array direction.

The plug housing 10 includes a stationary housing 20, which is mounted to the circuit board through the medium of the plug terminals 40, 50, and a movable housing 30, which is formed as a member separate from said stationary housing 20 and is movable relative to said stationary housing 20.

In the present embodiment, the plug connector 1 is made symmetrical in the connector-width direction (X-axis direction), i.e., in a direction that is parallel to the mounting face of the circuit board P1 and perpendicular to the terminal array direction. The stationary housing 20 is made of an electrically insulating material and is located in a region overlapping with the bottom half of the movable housing 30 in the vertical direction, i.e., in the heightwise direction of the plug connector 1, and it is provided so as to surround the hereinafter-described mating portion 31 of the movable housing 30 when viewed in the vertical direction and has a substantially rectangular parallelepiped-like external configuration extending such that the terminal array direction (Y-axis direction) is its longitudinal direction.

As can be seen in FIGS. 1 (A) and 1 (B), the stationary housing 20 has two stationary-side lateral walls 21 extending in the terminal array direction over a range including the movable housing 30, and two stationary-side end walls 22 extending in the connector-width direction and coupling the ends of the stationary-side lateral walls 21.

As can be seen in FIGS. 1 (A) and 1 (B), the outer lateral faces at both ends of the stationary-side lateral walls 21 in the terminal array direction (sections located in a range including the plug power supply terminals 50) are located outwardly of the intermediate portion (section located to include the array range of the plug signal terminals 40) in the connector-width direction. Stationary-side signal terminal retaining portions 21A (see FIG. 3), where the stationary-side retained portions 42 of the plug signal terminals 40 are retained in place via press-fitting, and stationary-side power supply terminal retaining portions 21B (see FIG. 7), where the stationary-side retained portions 52 of the plug power supply terminals 50 are retained in place via press-fitting, are formed on the interior wall surface of the stationary-side lateral walls 21.

Figure 7:
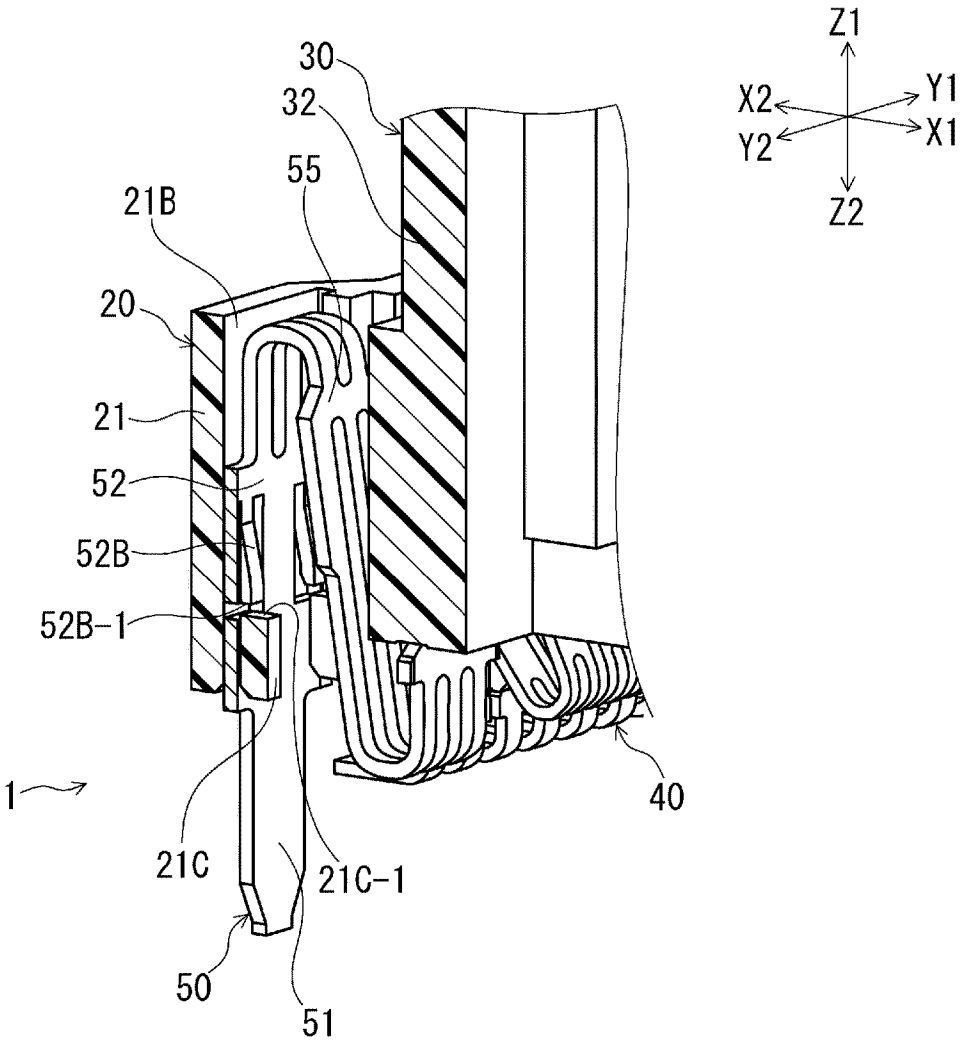
FIG. 7 illustrates a perspective cross-sectional view of an enlarged portion at the location of the power supply terminals of the receptacle connector illustrating the vicinity of the retained portions of said power supply terminals.

As can be seen in FIG. 3, the stationary-side signal terminal retaining portions 21A are formed as downwardly open groove portions recessed from the interior wall surface of the bottom half of the stationary-side lateral walls 21. In addition, as can be seen in FIG. 7, the stationary-side power supply terminal retaining portions 21B are formed as groove portions recessed from the interior wall surface of the stationary-side lateral walls 21 and extending in the vertical direction across the entire extent of the stationary-side lateral walls 21. Further, as can be seen in FIG. 7, the stationary-side lateral walls 21 have formed therein two engaged portions 21C that protrude from the edges on both sides of the lower portion of the stationary-side power supply terminal retaining portions 21B so as to converge toward each other in the terminal array direction (Y-axis direction). Said engaged portions 21C have a stepped configuration when viewed in the connector-width direction and terminal array direction, and their top faces constitute engaged faces 21C-1 capable of engagement with the hereinafter-described engaging portions 52B of the plug power supply terminals 50 from below.

In the central region in the connector-width direction (X-axis direction), the stationary-side end walls 22 have cutouts made in their bottom halves so as to form downwardly open notched portions 22A that pass therethrough in the wall-thickness direction (Y-axis direction). The stationary-side end walls 22 have formed therein restricting portions 22B in which a section extending in the connector-width direction at a location above the notched portion 22A couples the ends of the stationary-side lateral walls 21. Said restricting portions 22B are located above the hereinafter-described restricted portions 36 of the movable housing 30 and the bottom faces of said restricting portions 22B are formed as restricting faces 22B-1 that restrict upward travel of said restricted portions 36 in excess of a predetermined amount.

The movable housing 30, which is made of an electrically insulating material in the same manner as the stationary housing 20, has a mating portion 31 for mating with the receptacle connector 2 and restricted portions 36 restricted from travelling by said stationary housing 20. The mating portion 31 has two movable-side lateral walls 32 extending in the terminal array direction and two movable-side end walls 33 extending in the connector-width direction and coupling the ends of the movable-side lateral walls 32. In addition, an upwardly open space enclosed by the movable-side lateral walls 32 and movable-side end walls 33 is formed as a plug-side receiving portion 34 intended for receiving the hereinafter-described protruding wall 65 of the receptacle connector 2. As can be seen in FIGS. 2 (A) and 2(B), and FIG. 3, the lower end of said plug-side receiving portion 34 is sealed by a bottom wall 35 extending in the terminal array direction across the entire extent of the receiving portion 34.

In the array range of the plug signal terminals 40 in the terminal array direction, the movable-side lateral walls 32 extend vertically over a range corresponding to the top half of the plug connector 1 (see FIGS. 2 (A) and 2 (B)), and, at both ends in the terminal array direction (in the sections located outwardly of the above-mentioned array range), extend vertically over a range covering substantially the entire extent of the plug connector 1 in the vertical direction (see FIG. 7).

Holding groove portions 32A intended for receiving the hereinafter-described signal-type contact portions 43 of the plug signal terminals 40 are formed in the movable-side lateral walls 32 along the interior wall surface of said movable-side lateral walls 32 (see FIG. 3) and holding groove portions 32B, in which the hereinafter-described power supply-type contact portions 53 of the plug power supply terminals 50 are retained in place via press-fitting (see FIG. 1(A)), are formed along the exterior wall surface of said movable-side lateral walls 32. Said holding groove portions 32A are formed as vertically extending rectilinear groove portions recessed from the interior wall surface of the movable-side lateral walls 32. On the other hand, the holding groove portions 32B are located at both ends of the movable-side lateral walls 32 in the terminal array direction and are formed as vertically extending rectilinear groove portions recessed from the exterior wall surface of the movable-side lateral walls 32.

The movable-side end walls 33 extend over substantially the same range in the vertical direction as both ends in the terminal array direction of the movable-side lateral walls 32, in other words, over a range covering substantially the entire extent of the plug connector 1 in the vertical direction. In the bottom wall 35, movable-side signal terminal retaining portions 35A, in which the movable-side retained portions 44 of the plug signal terminals 40 are retained in place via press-fitting, are formed directly below the holding groove portions 32A of the movable-side lateral walls 32 and movable-side power supply terminal retaining portions (not shown), in which the movable-side retained portions 54 of the plug power supply terminals 50 are retained in place via press-fitting, are formed directly below the holding groove portions 32B of the movable-side lateral walls 32. The movable-side signal terminal retaining portions 35A and the movable-side power supply terminal retaining portions are configured as openings extending in the vertical direction and passing through the bottom wall 35, with said movable-side signal terminal retaining portions 35A placed in communication with the holding groove portions 32A and said movable-side power supply terminal retaining portions placed in communication with the holding groove portions 32B.

The restricted portions 36 protrude outwardly in the terminal array direction from both end faces of the lower portion of the movable housing 30 in the terminal array direction (faces perpendicular to the terminal array direction). As can be seen in FIGS. 1 (A) and 1 (B), said restricted portions 36 have a prismatic configuration and are push-fitted from within in the terminal array direction into the notched portions 22A of the stationary-side end walls 22 of the stationary housing 20. Therefore, said restricted portions 36 are located directly below the restricting portions 22B of the stationary-side end walls 22. The top faces of said restricted portions 36 (faces perpendicular to the vertical direction) are placed in a face-to-face relationship with the restricting faces 22B-1, i.e., the bottom faces of the restricting portions 22B, and are formed as restricted faces 36A abuttable against said restricting faces 22B-1. Said restricted faces 36A are positioned in an opposed spaced-apart relationship with the restricting faces 22B-1 in the vertical direction, and, as described hereafter, abut (are placed in surface contact with) the restricting faces 22B-1 from below during the upward travel of the movable housing 30. As a result, the upward travel of the movable housing 30 in excess of a predetermined amount is restricted.

As can be seen in FIGS. 1 (A) and 1 (B), in the plug connector 1, the plug terminals 40, 50 are arranged in two rows and, in each row, multiple plug signal terminals 40 are disposed at equal intervals. At the same time, one plug power supply terminal 50 is disposed on each side of the array range of said plug signal terminals 40 (see also FIGS. 2 (A) and 2 (B)).

Figure 5:
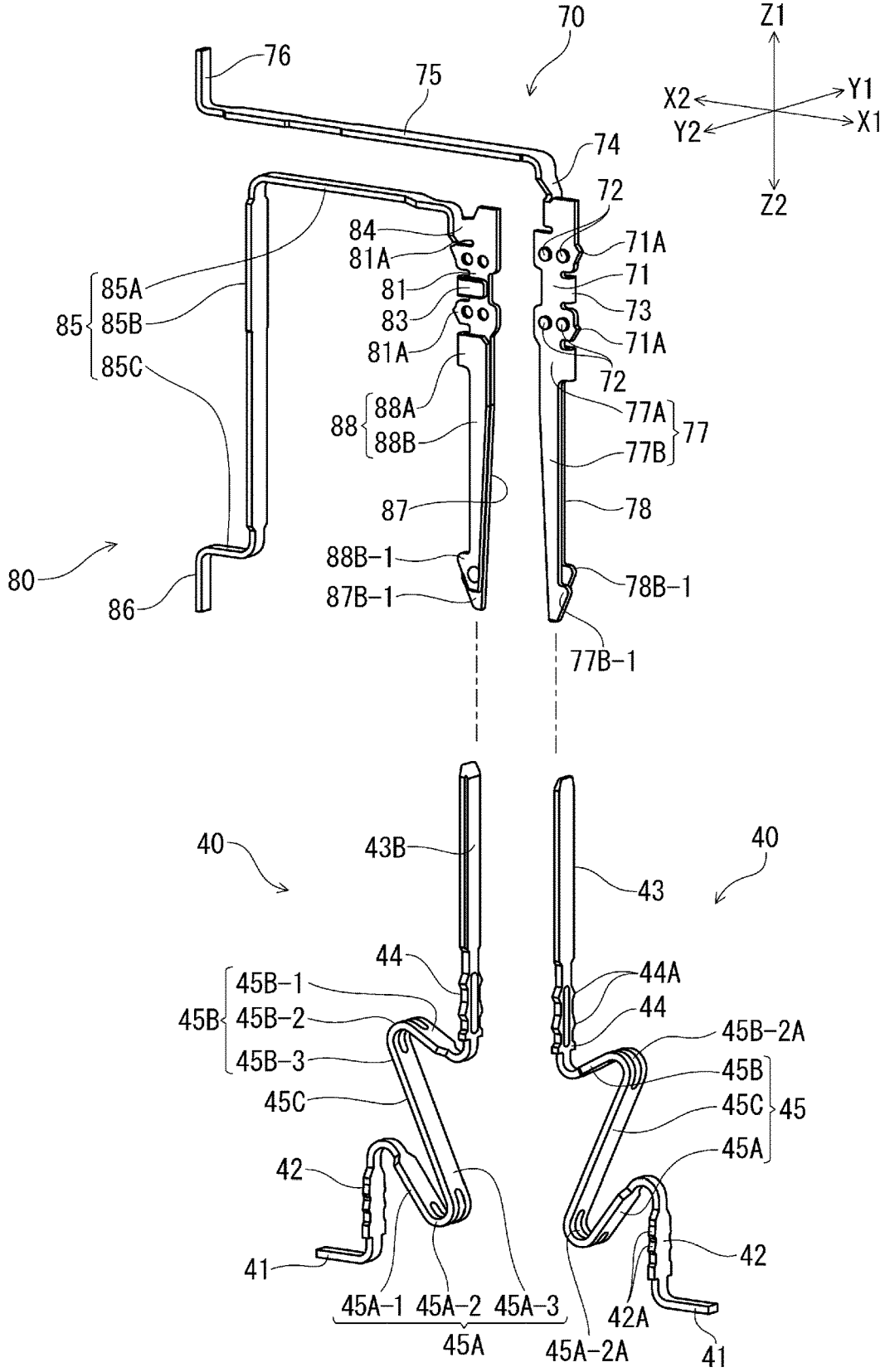
FIG. 5 illustrates a perspective view illustrating a pair of signal terminals extracted from the respective two connectors before connector mating illustrated in FIG. 1 (A).

As can be seen in FIGS. 2 (A) and 2 (B), FIG. 3, and FIG. 5, the plug signal terminals 40 are made by bending metal strip-like pieces in the through-thickness direction thereof and are disposed such that the terminal-width direction (direction perpendicular to the through-thickness direction of the plug signal terminals 40) coincides with the terminal array direction (Y-axis direction). As can be seen in FIG. 3, when the plug connector 1 is viewed in the terminal array direction, the plug signal terminals 40 have a signal-type connecting portion 41 formed at one end located below, a stationary-side retained portion 42 extending upwardly from said signal-type connecting portion 41, a signal-type contact portion 43 formed at the other end, which is located above the signal-type connecting portion 41 and inwardly in the connector-width direction, a movable-side retained portion 44 extending downwardly from said signal-type contact portion 43, and a signal-type resilient portion 45 coupling the stationary-side retained portion 42 and the movable-side retained portion 44. Said plug signal terminals 40 are provided in pairs symmetrical in the connector-width direction (X-axis direction), with multiple such pairs arranged in the terminal array direction (Y-axis direction).

As can be seen in FIG. 3, the signal-type connecting portions 41 extend outwardly in the connector-width direction at locations below the bottom face of the stationary housing 20 so as to be positioned on the mounting face (top face) of the circuit board P1 (see FIGS. 1 (A) and 1 (B)) and are adapted to be solder-connected to the corresponding circuitry of said mounting face. As can be seen in FIG. 3, the stationary-side retained portions 42 are made by bending at the inner end of the signal-type connecting portion 41 in the connector-width direction and extend upwardly, and are retained in place via press-fitting within the stationary-side signal terminal retaining portions 21A of the stationary housing 20. Specifically, as can be seen in FIG. 5, said stationary-side retained portions 42 have multiple press-fit projections 42A formed on the lateral edges extending vertically on both sides thereof in the terminal-width direction (Y-axis direction) and are retained in place because said press-fit projections 42A bite into the interior wall surface of the stationary-side signal terminal retaining portions 21A.

On the other hand, as can be seen in FIG. 3, the signal-type contact portions 43 extend in the vertical direction along the interior wall surface of said movable-side lateral walls 32 within the holding groove portions 32A of the movable-side lateral walls 32 of the movable housing 30. One major face of said signal-type contact portions 43 (face perpendicular to the through-thickness faces) is exposed to the plug-side receiving portion 34 and a hereinafter-described contact face 43B used for contact with the receptacle signal terminals 70, 80 is formed on said major face.

As can be seen in FIG. 3, the movable-side retained portions 44 extend downwardly in a continuous manner from the signal-type contact portions 43 within the movable-side signal terminal retaining portions 35A and are retained in place via press-fitting within said movable-side signal terminal retaining portions 35A. Specifically, as can be seen in FIG. 5, said movable-side retained portions 44 have multiple press-fit projections 44A formed on the lateral edges extending vertically on both sides thereof in the terminal-width direction (Y-axis direction) and are retained in place because said press-fit projections 44A bite into the interior wall surface of the movable-side signal terminal retaining portions 35A.

As can be seen in FIGS. 3 to 5, the signal-type resilient portion 45 has a lower curved portion 45A curved in a substantially U-shaped configuration at the lower end of said signal-type resilient portion 45, an upper curved portion 45B curved in a substantially inverted U-shaped configuration at the upper end of said signal-type resilient portion 45, and a rectilinear coupling portion 45C coupling said lower curved portion 45A and the upper curved portion 45B, and is capable of resilient displacement in the connector-width direction (X-axis direction).

As can be seen in FIG. 5, the lower curved portion 45A has a lower external arm portion 45A-1, which is bent at the upper end of the stationary-side retained portion 42 and extends at an inward inclination in the connector-width direction as one moves downwardly, a lower folded portion 45A-2, which is folded back at the lower end of said lower external arm portion 45A-1, and a lower internal arm portion 45A-3, which extends at an outward inclination in the connector-width direction as one moves upwardly from said lower folded portion 45A-2. In other words, as can be seen in FIG. 3, the lower curved portion 45A has an obliquely upwardly open substantially U-shaped configuration inclined outwardly in the connector-width direction. Said lower curved portion 45A is capable of resilient displacement in the connector-width direction by increasing and reducing the spacing between the lower external arm portion 45A-1 and the lower internal arm portion 45A-3.

As can be seen in FIG. 5, the upper curved portion 45B has an upper internal arm portion 45B-1, which is bent at the lower end of the movable-side retained portion 44 and extends at an outward inclination in the connector-width direction as one moves upwardly, a upper folded portion 45B-2, which is folded back at the upper end of said upper internal arm portion 45B-1, and an upper external arm portion 45B-3, which extends at an inward inclination in the connector-width direction as one moves downwardly from said upper folded portion 45B-2. In other words, as can be seen in FIG. 3, the upper curved portion 45B has an obliquely downwardly open substantially inverted U-shaped configuration inclined inwardly in the connector-width direction. Said upper curved portion 45B is capable of resilient displacement in the connector-width direction by increasing and reducing the spacing between the upper internal arm portion 45B-1 and the upper external arm portion 45A-3.

As can be seen in FIG. 3, the coupling portion 45C couples the upper end of the lower internal arm portion 45A-3 and the lower end of the upper external arm portion 45B-3, and extends at an inward inclination in the connector-width direction as one moves downwardly. As can be seen in FIG. 3, the coupling portion 45C, which extends vertically at an inclination in this manner, is positioned such that there is an area of overlap between the lower external arm portion 45A-1 of the lower curved portion 45A and the upper internal arm portion 45B-1 of the upper curved portion 45B in the connector-width direction. Therefore, the dimensions of the signal-type resilient portion 45 in the connector-width direction become smaller by this area of overlap and, as a result, the plug connector 1 can be made more compact in the connector-width direction.

In the plug signal terminals 40, floating is implemented via resilient displacement of the lower curved portions 45A and the upper curved portions 45B of the signal-type resilient portions 45 in the connector-width direction. In addition, in the present embodiment, the overall length of said signal-type resilient portions 45 becomes longer owing to the provision of the lower curved portions 45A and upper curved portions 45B in the signal-type resilient portions 45, and the extent of floating is increased.

As can be seen in FIG. 5, the lower folded portion 45A-2 of the lower curved portion 45A has formed therein a slit-like lower opening 45A-2A, which passes therethrough in the through-thickness direction in the central region in the terminal-width direction thereof while extending in the longitudinal direction of said lower folded portion 45A-2. Consequently, the lower folded portion 45A-2 includes two strips that are narrower in width than the lower external arm portion 45A-1 and lower internal arm portion 45A-3, thereby ensuring a sufficiently high level of resilience. In addition, as can be seen in FIG. 5, a slit-like upper opening 45B-2A similar to that of the above-described lower folded portion 45A-2 is formed in the upper folded portion 45B-2 of the upper curved portion 45B and a sufficiently high level of resilience is ensured by two strips that are narrower in width than the upper internal arm portion 45B-1 and the upper external arm portion 45B-3.

As can be seen in FIG. 3 and FIG. 5, in the present embodiment, the lower curved portion 45A and the upper curved portion 45B of the plug signal terminals 40 are curved so as to have sections overlapping in the vertical direction. Specifically, as can be seen in FIG. 5, the lower internal arm portion 45A-3 and the lower external arm portion 45A-1 in the lower curved portion 45A as well as the upper external arm portion 45B-3 and the upper internal arm portion 45B-1 in the upper curved portion 45B are located within a region of mutual overlap in the vertical direction. Therefore, the dimensions of the signal-type resilient portion 45 in the vertical direction and, consequently, the dimensions of the plug connector 1 are reduced by this area of overlap, thereby ensuring a lower profile for the plug connector 1.

Although in the present embodiment the signal-type resilient portion 45 has two curved portions, i.e., the lower curved portion 45A and the upper curved portion 45B, as an alternative, said portions may be adapted to have only one of the lower curved portion 45A and the upper curved portion 45B. In addition, although in the present embodiment the curved portions are formed at the ends of the signal-type resilient portion 45 in the longitudinal direction, as an alternative, the curved portions may be formed in the intermediate portion of the signal-type resilient portion 45 in the longitudinal direction. Providing a bend in a section of the signal-type resilient portions ensures a commensurately lower profile for the plug connector 1.

In addition, in the present embodiment, the signal-type resilient portions 45 are curved not in their entirety, but only in a portion of the signal-type resilient portions 45 in the longitudinal direction of the plug signal terminals 40, in other words, in the lower curved portion 45A formed at the lower end of the signal-type resilient portions 45 and in the upper curved portion 45B formed at the upper end. Consequently, the extent of the section of vertical overlap in the curved sections (lower curved portion 45A and upper curved portion 45B) is smaller in comparison with bending the signal-type resilient portions 45 in their entirety. As a result, cross-talk is less likely to occur in the signal-type resilient portions 45 and the degradation of high-speed transmission characteristics can be kept to a minimum.

Although in the present embodiment the signal-type resilient portion 45 has two curved portions, i.e., the lower curved portion 45A and the upper curved portion 45B, as an alternative, said portions may be adapted to have only one of the lower curved portion 45A and the upper curved portion 45B. In addition, although in the present embodiment the curved portions are formed at the ends of the signal-type resilient portion 45 in the longitudinal direction, as an alternative, the curved portions may be formed in the intermediate portion of the signal-type resilient portion 45 in the longitudinal direction. Providing a bend in a section of the signal-type resilient portions ensures a commensurately lower profile for the plug connector 1.

Figure 6:
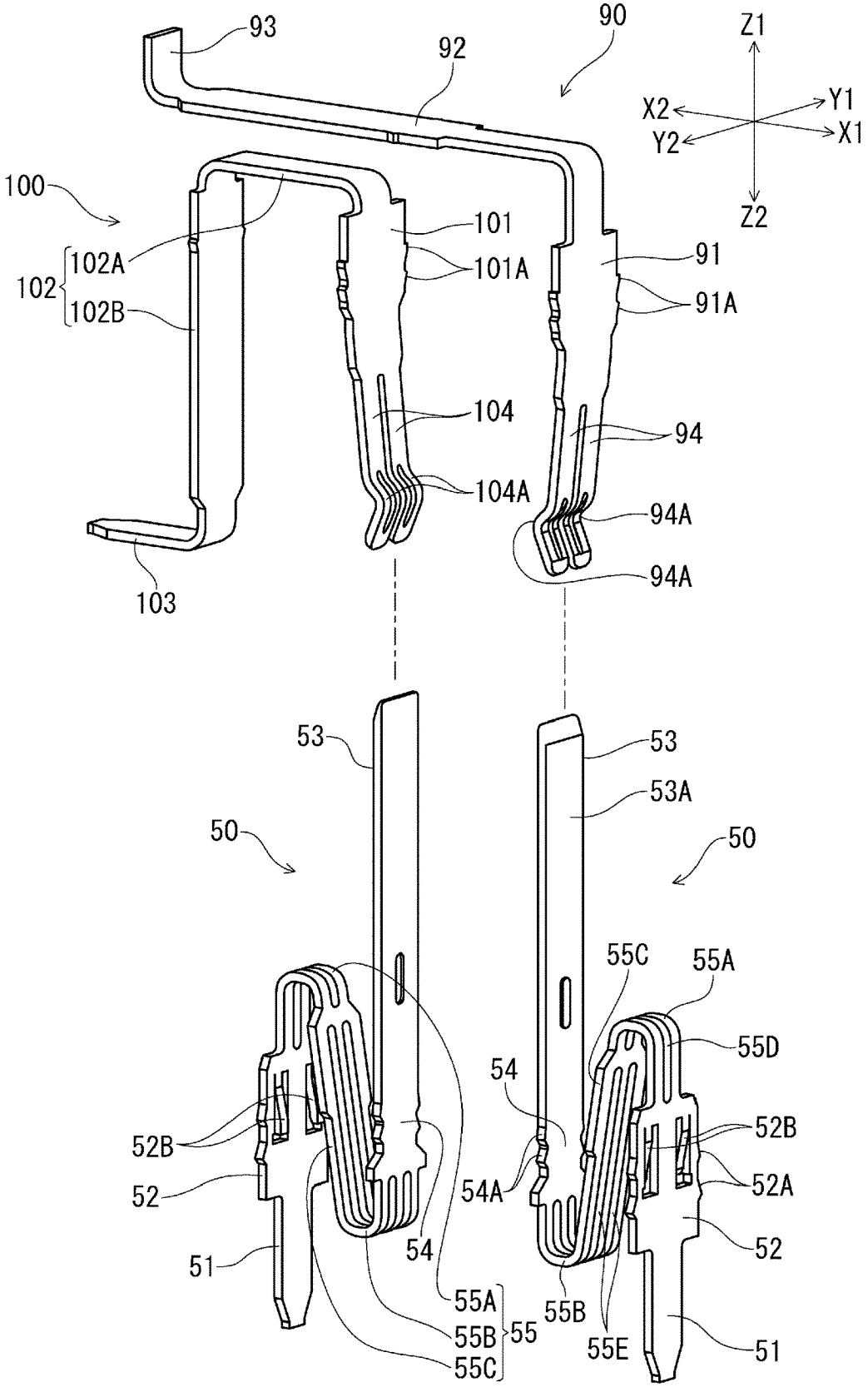
FIG. 6 illustrates a perspective view illustrating a pair of power supply terminals extracted from the respective two connectors before connector mating illustrated in FIG. 1 (A).

As can be seen in FIG. 6, the plug power supply terminals 50 are made by bending metal strip-like pieces in the through-thickness direction thereof and are disposed such that the terminal-width direction (direction perpendicular to the through-thickness direction of the plug signal terminals 40) coincides with the terminal array direction (Y-axis direction). Said plug power supply terminals 50 are formed such that their dimensions in the terminal-width direction are larger than those of the plug signal terminals 40.

As can be seen in FIG. 6, when the plug connector 1 is viewed in the terminal array direction, the plug power supply terminals 50 have a power supply-type connecting portion 51 formed at one end located below, a stationary-side retained portion 52 extending upwardly from said power supply-type connecting portion 51, a power supply-type contact portion 53 formed at the other end, which is located above the power supply-type connecting portion 51 and inwardly in the connector-width direction, a movable-side retained portion 54 extending downwardly from said power supply-type contact portion 53, and a power supply-type resilient portion 55 coupling the stationary-side retained portion 52 and the movable-side retained portion 54. Said plug power supply terminals 50 are provided in pairs symmetrical in the connector-width direction (X-axis direction), with such pairs retained in place at both ends of the plug connector 1 in the terminal array direction (Y-axis direction).

The power supply-type connecting portions 51 extend vertically in a rectilinear manner at locations below the bottom face of the stationary housing 20. When the plug connector 1 is disposed on the mounting face of the circuit board P1 (see FIGS. 1 (A) and 1 (B)), said power supply-type connecting portions 51 are positioned by passing through through-holes H formed in said circuit board P1 (see FIGS. 1 (A) and 1 (B)) from above and are solder-connected to said through-holes H. As can be seen in FIG. 3, said power supply-type connecting portions 51 are located more inwardly in the connector-width direction, in other words, closer to the signal-type contact portions 43 of the plug signal terminals 40 in the wall-thickness direction of the stationary-side lateral walls 21 of the stationary housing 20 (X-axis direction) than the signal-type connecting portions 41 of the plug signal terminals 40. In the present embodiment, positioning the power supply-type connecting portion 51 in this manner makes it possible to avoid increasing the plug connector 1 in size in the connector-width direction.

The stationary-side retained portions 52 extend upwardly in a continuous manner from the power supply-type connecting portions 51 and are retained in place via press-fitting within the stationary-side power supply terminal retaining portions 21B of the stationary housing 20 (see FIG. 7). Specifically, as can be seen in FIG. 6, said stationary-side retained portions 52 have multiple press-fit projections 52A formed on the lateral edges extending vertically on both sides thereof in the terminal-width direction (Y-axis direction) and are retained in place because said press-fit projections 52A bite into the interior wall surface of the stationary-side power supply terminal retaining portions 21B (see FIG. 7).

In the present embodiment, the stationary-side retained portions 52 are retained in place such that their through-thickness direction coincides with the wall-thickness direction of the stationary-side lateral walls 21 of the stationary housing 20 (X-axis direction) and, for this reason, the dimensions of the stationary-side retained portions 52 in the wall-thickness direction of said stationary-side lateral walls 21 are small, corresponding to the through-thickness dimensions of said stationary-side retained portions 52. Therefore, the size of the plug connector 1 in the above-mentioned wall-thickness direction is not increased because the stationary-side retained portions 52 can be positioned within bounds of the wall thickness of the stationary-side lateral walls 21 without increasing said wall thickness.

In addition, the stationary-side retained portions 52 have provided therein engaging portions 52B engageable with the engaged portions 21C of the stationary housing 20 (see FIG. 7) at two locations in the terminal-width direction. Said engaging portions 52B are formed as resilient strips cut and raised inwardly in the connector-width direction from the major faces of the stationary-side retained portions 52. In other words, said engaging portions 52B extend in a gently sloping manner inwardly in the connector-width direction as one moves downward, with the lower ends thereof having a free-end cantilever configuration. As can be seen in FIG. 7, the lower end faces of said engaging portions 52B are located directly above the engaged faces 21C-1, i.e., the top faces of the above-mentioned engaged portions 21C, and constitute engaging faces 52B-1 capable of engaging said engaged faces 21C-1.

As described hereafter, when an external force oriented upwardly (in the direction of connector extraction) acts upon the stationary housing 20 during connector extraction, the engaging faces 52B-1 of the engaging portions 52B engage from above the engaged faces 21C-1 of the engaged portions 21C of the upwardly lifted stationary housing 20. As a result, upward travel of the stationary housing 20 in excess of a predetermined amount is restricted, and the detachment of the plug connector 1 from the circuit board P1 is adequately prevented.

In the present embodiment, as mentioned before, the engaging portions 52B are formed as resilient strips cut and raised from the major faces of the stationary-side retained portions 52. In other words, since the engaging portions 52B are located within the bounds of said stationary-side retained portions 52 in the terminal-width direction (Y-axis direction), a sufficient surface area of engagement can be ensured in the engaging portions 52B without increasing the size of the stationary-side retained portions 52 in said terminal-width direction. In addition, since there are two engaging portions 52B formed within the bounds of the stationary-side retained portions 52 in the terminal-width direction, the above-mentioned surface area of engagement can be made larger in comparison with forming just one engaging portion 52B.

The power supply-type contact portions 53 extend in the vertical direction along the exterior wall surface of said movable-side lateral walls 32 within the holding groove portions 32B of the movable-side lateral walls 32 of the movable housing 30. One major face of said power supply-type contact portions 53 (face perpendicular to the through-thickness faces) is exposed outwardly in the connector-width direction. Said major face has formed therein a contact face 53A intended for contact with the receptacle power supply terminals 90, 100 (see FIG. 1(A)).

The movable-side retained portions 54 extend in a continuous manner downwardly from the power supply-type contact portions 53 within movable-side power supply terminal retaining portions (not shown) and are retained in place via press-fitting within said movable-side power supply terminal retaining portions. Specifically, as can be seen in FIG. 6, said movable-side retained portions 54 have multiple press-fit projections 54A formed on the lateral edges extending vertically on both sides thereof in the terminal-width direction and are retained in place because said press-fit projections 54A bite into the interior wall surface of the movable-side signal terminal retaining portions.

As can be seen in FIG. 6, the power supply-type resilient portions 55 have an upper curved portion 55A curved in a substantially inverted U-shaped configuration at the upper end of said power supply-type resilient portions 55, a lower curved portion 55B curved in a substantially U-shaped configuration at the lower end of said power supply-type resilient portions 55, and a rectilinear coupling portion 55C coupling said upper curved portion 55A and the lower curved portion 55B, and are capable of resilient displacement in the connector-width direction.

The substantially inverted U-shaped upper curved portion 55A and substantially U-shaped lower curved portion 55B have two arm portions extending in the vertical direction. Said upper curved portion 55A and said lower curved portion 55B are capable of resilient displacement in the connector-width direction by increasing and reducing the spacing between said two arm portions. As a result, the power supply-type resilient portions 55 are enabled for floating by resilient displacement in the connector-width direction.

As can be seen in FIG. 6, the coupling portion 55C couples the lower end of the arm portion located inwardly of the upper curved portion 55A in the connector-width direction and the upper end of the arm portion located outwardly of the lower curved portion 55B in the connector-width direction and extends at an inward inclination in the connector-width direction as one moves downwardly.

As can be seen in FIG. 6, in the power supply-type resilient portions 55, the outer side in the connector-width direction of the arm portion located in the upper curved portion 55A and the fold-back section (upper end) are formed to be narrower in width, while the other section is formed to be of greater width. A slit portion 55D, which extends in the longitudinal direction of the power supply-type resilient portion 55, is formed in the narrow section. Said slit portion 55D passes therethrough in the through-thickness direction in the central region in the terminal-width direction (Y-axis direction) of the power supply-type resilient portion 55. In other words, the above-mentioned narrow section is formed by two thin strips. In addition, the wide section has two slit portions 55E formed therein that extend in the longitudinal direction of the power supply-type resilient portion 55. Said two slit portions 55E pass therethrough in the through-thickness direction at two locations in the intermediate region of the power supply-type resilient portion 55 in the terminal-width direction (Y-axis direction). In other words, the above-mentioned wide section is formed by three thin strips. Thus, sufficiently high resilience is ensured because the power supply-type resilient portions 55 are formed by two thin strips and three thin strips.

The thus-configured plug connector 1 is manufactured in the following manner. First of all, the movable-side retained portions 44 of the plug signal terminals 40 and the movable-side retained portions 54 of the plug power supply terminals 50 are press-fitted upwardly, i.e., from below the movable housing 30, into the movable-side signal terminal retaining portions 35A and movable-side power supply terminal retaining portions 35B of the movable housing 30 thereby causing the plug terminals 40, 50 to be retained in place in the movable housing 30. As a result, the signal-type contact portions 43 of the plug signal terminals 40 and the power supply-type contact portions 53 of the plug power supply terminals 50 are received in the holding groove portions 32A and holding groove portions 32B of the movable housing 30.

Although in the present embodiment the shape of the power supply-type resilient portions 55 of the plug power supply terminals 50, when viewed in the terminal array direction, is different from that of the signal-type resilient portions 45 of the plug signal terminals 40, as an alternative, the power supply-type resilient portions may be formed in the same shape as the signal-type resilient portions 45. In addition, if the plug connector is provided with ground terminals, grounding-type resilient portions provided in said ground terminals may be formed in the same shape as the above-mentioned signal-type resilient portions 45.

Next, the stationary-side retained portions 42 of the plug signal terminals 40 and the stationary-side retained portions 52 of the plug power supply terminals 50 are press-fitted upwardly, i.e., from below the stationary housing 20, into the stationary-side signal terminal retaining portions 21A and the stationary-side power supply terminal retaining portions 21B of the stationary housing 20, thereby causing the plug terminals 40, 50 to be retained in place in the stationary housing 20. Thus, the mounting of the plug terminals 40, 50 to the stationary housing 20 and movable housing 30 completes the plug connector 1.

The receptacle connector 2 has a receptacle housing 60, which extends such that a direction (Y-axis direction) parallel to the mounting face of the circuit board P2 (see FIG. 1 (A, B)) is its longitudinal direction, and receptacle signal terminals 70, 80 and receptacle power supply terminals 90, 100 (referred to as "receptacle terminals 70, 80, 90, 100" for brevity below when there is no need to distinguish the two), which are retained in place in array form in the receptacle housing 60 such that the longitudinal direction is the terminal array direction. Multiple receptacle signal terminals 70, 80 are arranged in the intermediate area of the receptacle housing 60 in the terminal array direction, and the receptacle power supply terminals 90, 100 are provided on both sides of the array range of the receptacle signal terminals 70, 80 in the terminal array direction.

The receptacle housing 60 has end walls 61 with major faces thereof perpendicular to the terminal array direction at locations on both ends of said receptacle housing 60 in the terminal array direction, and an intermediate portion 62, which extends between said two end walls 61 in the terminal array direction and retains the receptacle terminals 70, 80, 90, 100 in place in array form.

As can be seen in FIGS. 1 (A) to 4, the upper end of the intermediate portion 62 is located below the upper end of the end walls 61. A receptacle signal terminal holding portion 63 used to hold and retain in place the receptacle signal terminals 70, 80 is formed and arranged in the terminal array direction at a location substantially in the right-hand half (section on side X1) of said intermediate portion 62 in the connector-width direction (X-axis direction) in FIG. 3 and, in addition, receptacle power supply terminal holding portions (not shown) used to hold and retain in place the receptacle power supply terminals 90, 100 are formed at locations on both sides of said intermediate portion 62. In addition, a downwardly open receptacle-side receiving portion 64 used for receiving the mating portion 31 of the plug connector 10 is formed at a location substantially in the right-hand half (section on side X1) of the bottom half of said intermediate portion 62 in the connector-width direction (X-axis direction) in FIG. 3 (see FIGS. 3 and 4). In addition, an island-shaped protruding wall 65, which protrudes downwardly (in the Z2 direction) and extends in the terminal array direction (Y-axis direction), is formed inside the receptacle-side receiving portion 64.

Before describing the shape of the receptacle signal terminal holding portion 63 and receptacle power supply terminal holding portion (not shown), first, explanations will be provided regarding the shape of the receptacle signal terminals 70, 80 and receptacle power supply terminals 90, 100.

The receptacle signal terminals 70, 80 include first receptacle signal terminals 70 and second receptacle signal terminals 80, which are different in shape. In the present embodiment, a single row of multiple first receptacle signal terminals 70 and a single row of multiple second receptacle signal terminals 80 are retained in place in the intermediate portion 62 of the receptacle housing 60.

As can be seen in FIG. 5, the first receptacle signal terminals 70 have a vertically extending retained portion 71, which is made by bending a sheet metal member in the through-thickness direction; protrusions 72 serving as first abutment portions, which protrude from one major face of said retained portion 71; a tongue 73 serving as a second abutment portion, which is folded back at a lateral edge of said retained portion 71 toward the other major face and extends in the connector-width direction; a transitional portion 74, which continues from the top portion of said retained portion 71; an extension portion 75, which is bent at the upper end of said transitional portion 74 and extends in a rectilinear manner in the connector-width direction toward the circuit board P2 side (side X2); a signal-type connecting portion 76, which is bent and extends upwardly at the end of said extension portion 75 located closer to the circuit board P2; and contact arm portions 77, 78, which extend downwardly from the lower end of the retained portion 71.

As can be seen in FIG. 3, the retained portion 71 is located proximate to the upper end of the receptacle housing 60 and disposed such that the through-thickness direction of said retained portion 71 coincides with the terminal array direction (Y-axis direction perpendicular to the plane of the drawing in FIG. 3). In other words, the multiple first receptacle signal terminals 70 are arranged in an orientation in which the major faces of the retained portions 71 are opposed to each other in the terminal array direction. Said retained portions 71 have press-fit projections 71A protruding from the lateral edge thereof located closer to side X1 in the connector-width direction (of the two vertically extending lateral edges thereof), with one of said projections being at a location proximate to the upper end and another at a location proximate to the lower end of said retained portions 71. As described hereafter, said retained portions 71 are adapted to be retained in place in said first signal terminal retaining portion 63A because the press-fit projections 71A bite into the interior wall surface of the first signal terminal retaining portion 63A of the receptacle housing 60.

Two protrusions 72 are formed at two locations in the vertical direction, specifically, at substantially the same locations as the press-fit projections 71A, with said two protrusions 72 being arranged in the connector-width direction (X-axis direction). As can be seen in FIG. 5, said protrusions 72 are formed by embossing, for example, in such a way that they protrude from one major face located closer to side Y2 in the terminal array direction (Y-axis direction) (of the two major faces of the retained portion 71). In other words, said protrusions 72 are located closer to side Y2 than to said one major face of the retained portion 71. In the Y-axis direction, said protrusions 72 are located proximate to the interior wall surface (one interior wall surface) of the first signal terminal retaining portion 63A opposed to said one major face and are abuttable along their protruding top faces (see FIG. 8 (B)).

A single tongue 73 is formed at a location between the press-fit projections 71A in the vertical direction, in other words, at a location between the protrusions 72 in the vertical direction. Said tongue 73 is folded back toward the other major face of said retained portion 71 (side Y1) at the lateral edge of the retained portion 71 located closer to side X1, in other words, to the lateral edge where the press-fit projections 71A are formed, and extends in the connector-width direction toward side X2 (see FIG. 8(A)). In other words, said tongue 73 is located closer to side Y1 than to the other major face of the above-mentioned retained portion 71. In the Y-axis direction, said tongue 73 is located proximate to the interior wall surface (the other interior wall surface) of the first signal terminal retaining portion 63A closely opposed to said other major face and is abuttable along its major faces (see FIG. 8 (B)). It is to be noted that, while in the present embodiment the tongue 73 is designed to be formed by folding back at the lateral edge where the press-fit projections 71A of the retained portion 71 are formed, as an alternative, it may be formed by folding back at the opposite lateral edge.

Figure 8B:
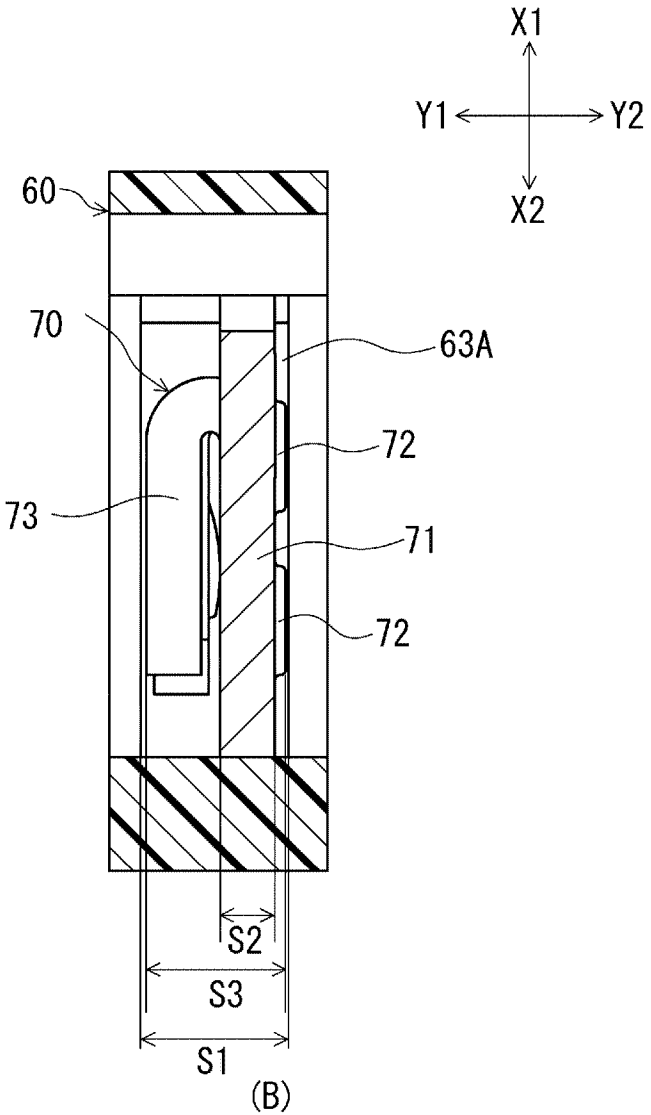
FIG. 8 (A) is a perspective view illustrating a pair of signal terminals of the receptacle connector as viewed in the terminal array direction from the opposite side to that of the signal terminals of FIG. 5, and FIG. 8 (B) is a cross-sectional view illustrating one of the pair of signal terminals illustrated in (A) retained in place in the housing.

The transitional portion 74 and the extension portion 75 are located within the hereinafter-described upper holding portion 63E of the receptacle signal terminal holding portion 63. As can be seen in FIG. 5 and FIG. 8 (A), said transitional portion 74 is bent at a right angle toward side Y1 at the lateral edge of the top portion of the retained portion 71 located closer to side X2 and then extends upwardly, with the upper end of said transitional portion 74 located above the upper end of the retained portion 71. In addition, the extension portion 75 is bent at a right angle toward side X2 at the upper end of the transitional portion 74 and extends toward side X2.

As can be seen in FIG. 3, the signal-type connecting portion 76 is located outside of the receptacle housing 60 and, when the receptacle connector 2 is disposed on the mounting face of the circuit board P2 (see FIG. 1), is in surface contact with, and solder-connected to, the corresponding signal circuitry on said mounting face.

As can be seen in FIG. 5 and FIG. 8 (A), the two contact arm portions 77, 78 include a long contact arm portion 77 and short contact arm portion 78 having a shorter arm length than said long contact arm portion 77 and are positioned such that the major faces of the long contact arm portion 77 and the major faces of the short contact arm portion 78 are opposed to each other in the terminal array direction (Y-axis direction).

The long contact arm portion 77 has a base portion 77A, which is coupled to the lower end of the retained portion 71, and a resilient arm portion 77B, which extends downwardly from said base portion 77A. Said resilient arm portion 77B is capable of resilient displacement in the connector-width direction (X-axis direction), in other words, in the XZ plane, and, as can be seen in FIG. 3, is contactable, under contact pressure, with the plug signal terminals 40 of the plug connector 1 through the medium of a signal-type contact portion 77B-1, which protrudes toward side X1 at the lower end of said resilient arm portion 77B and is located within the receptacle-side receiving portion 64 of the receptacle housing 60 (see also FIG. 4).

Figure 8A:
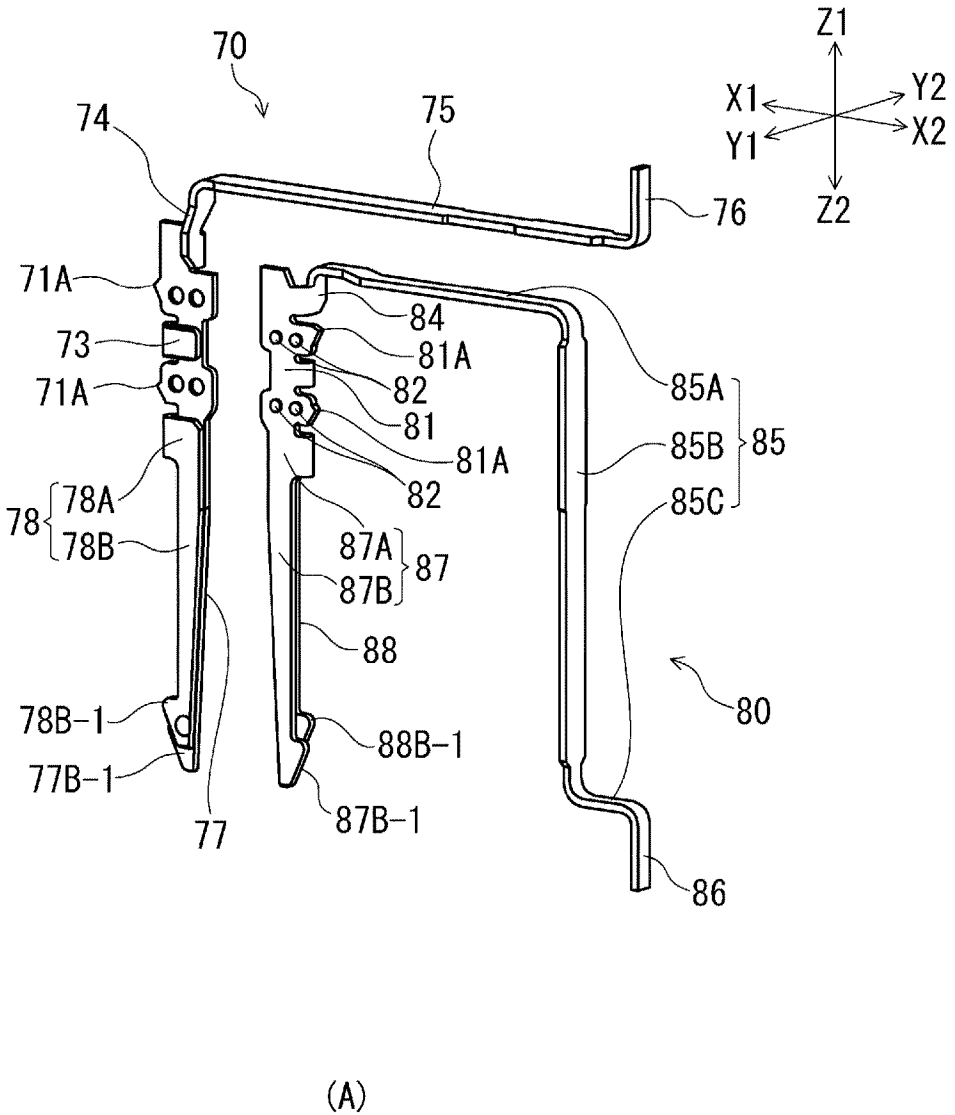

The short contact arm portion 78 has a base portion 78A folded back at the lateral edge of the base portion 77A of the long contact arm portion 77 located closer to side X1 (see FIG. 8(A)), and a resilient arm portion 78B extending downwardly from said base portion 78A. Said resilient arm portion 78B is capable of resilient displacement in the connector-width direction (X-axis direction), in other words, in the XZ plane, independently of the resilient arm portion 77B of the long contact arm portion 77, and is contactable, under contact pressure, with the plug signal terminals 40 of the plug connector 1 through the medium of a signal-type contact portion 78B-1, which protrudes toward side X1 at the lower end of said resilient arm portion 78B and is located within the receptacle-side receiving portion 64 of the receptacle housing 60 (see also FIG. 4).

As can be seen in FIG. 5, the resilient arm portion 78B has a shorter arm length than the resilient arm portion 77B of the long contact arm portion 77. The signal-type contact portion 78B-1 of the resilient arm portion 78B is located slightly above the signal-type contact portion 77B-1 of the resilient arm portion 77B (see also FIG. 8 (A)). Therefore, the receptacle signal terminals 70 are contactable with the plug signal terminals 40 through the medium of two signal-type contact portions 77B-1, 78B-1, which are located differently from each other in the vertical direction, thereby achieving an improvement in the reliability of contact with said plug signal terminals 40.

As can be seen in FIG. 3, in the connector-width direction (X-axis direction), the second receptacle signal terminal 80 is located closer to the circuit board P2 (side X2) than the contact arm portions 77, 78 and retained portion 71 of the first receptacle signal terminals 70 in the vertical direction (Z-axis direction) and below the extension portion 75 of the first receptacle signal terminals 70.

As can be seen in FIG. 5, the second receptacle signal terminals 80 have a vertically extending retained portion 81; protrusions 82 serving as first abutment portions, which protrude from one major face of said retained portion 81; a tongue 83 serving as a second abutment portion, which is folded back at a lateral edge of said retained portion 81 toward the other major face and extends in the connector-width direction; a transitional portion 84, which continues from the top portion of said retained portion 81; an extension portion 85, which is bent at the upper end of said transitional portion 84 and extends in a crank-like configuration in the connector-width direction toward the circuit board P2 side (side X2); a signal-type connecting portion 86, which is bent and extends downwardly at the end of said extension portion 85 located closer to the circuit board P2; and contact arm portions 87, 88, which extend downwardly from the lower end of the retained portion 81.

As can be seen in FIG. 3, the retained portion 81 is made smaller than the retained portion 71 of the first receptacle signal terminals 70 in the vertical direction, and the lower end of said retained portion 81 is located substantially at the same height in the vertical direction as the lower end of said retained portion 71. Said retained portion 81 is disposed such that the through-thickness direction of said retained portion 81 coincides with the terminal array direction. In other words, similar to the first receptacle signal terminals 70, the multiple second receptacle signal terminals 80 are also arranged in an orientation in which the major faces of the retained portions 81 are opposed to each other in the terminal array direction. Said retained portions 81 have press-fit projections 81A protruding from the lateral edge thereof located closer to side X2 in the connector-width direction (of the two vertically extending lateral edges thereof), with one of said projections being at a location proximate to the upper end and another at a location proximate to the lower end of said retained portions 81. As described hereafter, said retained portions 81 are adapted to be retained in place in said second signal terminal retaining portion 63B because the press-fit projections 81A bite into the interior wall surface of the second signal terminal retaining portion 63B of the receptacle housing 60.

As can be seen in FIG. 8 (A), two protrusions 82 are formed at two locations in the vertical direction, specifically, at substantially the same locations as the press-fit projections 81A, with said two protrusions 82 being arranged in the connector-width direction (X-axis direction). Said protrusions 82 are formed by embossing, for example, in such a way that they protrude from one major face located closer to side Y1 in the terminal array direction (Y-axis direction) (of the two major faces of the retained portion 81). In other words, said protrusions 82 are located closer to side Y1 than to said one major face of said retained portion 81, i.e., on the side opposite to the protrusions 72 of the first receptacle signal terminals 70 in the Y-axis direction (see FIG. 5), and are abuttable along the protruding top faces of said protrusions 82 against the interior wall surface (one interior wall surface) of the second signal terminal retaining portion 63B opposed to said one major face in the Y-axis direction.

As can be seen in FIG. 8 (A), a single tongue 83 is formed at a location between the press-fit projections 81A in the vertical direction, in other words, at a location between the protrusions 82 in the vertical direction (see FIG. 5). Said tongue 83 is folded back toward the other major face of said retained portion 81 (side Y2) at the lateral edge of the retained portion 81 located closer to side X2, in other words, to the lateral edge where the press-fit projections 81A are formed, and extends in the connector-width direction toward side X1. In other words, said tongue 83 is located closer to side Y2 than to the other major face of the above-mentioned retained portion 81, i.e., on the side opposite to the tongue 83 of the first receptacle signal terminals 70 in the Y-axis direction, and is abuttable along the major face of said tongue 83 against the interior wall surface (other interior wall surface) of the second signal terminal retaining portion 63B opposed to said other major face in the Y-axis direction. It should be noted that while in the present embodiment the tongue 83 is designed to be formed by folding back at the lateral edge where the press-fit projections 81A of the retained portion 81 are formed, as an alternative, it may be formed by folding back at the opposite lateral edge.

The transitional portion 84 is located within the second signal terminal retaining portion 63B of the receptacle signal terminal holding portion 63. As can be seen in FIG. 5, said transitional portion 84 is formed by bending at a right angle toward side Y2 at the lateral edge of the top portion of the retained portion 81 located closer to side X2, and the upper end of said transitional portion 84 is located substantially at the same position as the upper end of the retained portion 71 of the first receptacle signal terminals 70 in the vertical direction.

As can be seen in FIG. 5, the extension portion 85 has a top transverse portion 85A, which is bent at a right angle at the upper end of the transitional portion 84 and extends toward side X2; a vertical portion 85B, which is bent at a right angle at the end of said top transverse portion 85A located closer to side X2 and extends downward; and a bottom transverse portion 85C, which is bent at a right angle at the lower end of said vertical portion 85B and extends toward side X2. The top transverse portion 85A, which is located within the hereinafter-described upper holding portion 63E of the receptacle signal terminal holding portion 63, is shorter than the extension portion 75 of the first receptacle signal terminals 70 in the longitudinal direction (X-axis direction) (see also FIG. 3). The vertical portion 85B is located within the hereinafter-described lateral holding portions 63F of the receptacle signal terminal holding portion 63. As can be seen in FIG. 5, the end of the bottom transverse portion 85C located closer to side X2 projects outside of the receptacle housing 60.

As can be seen in FIG. 3, the signal-type connecting portion 86 is located outside of the receptacle housing 60 in the same position as the signal-type connecting portion 76 of the receptacle signal terminals 70 in the X-axis direction and, when the receptacle connector 2 is disposed on the mounting face of the circuit board P2, is in surface contact with, and solder-connected to, the corresponding signal circuitry on said mounting face.

As can be seen in FIG. 5 and FIG. 8 (A), the two contact arm portions 87, 88 include a long contact arm portion 87 and a short contact arm portion 88 having a shorter arm length than said long contact arm portion 87. The shape of said contact arm portions 87, 88 is obtained by rotating the previously discussed contact arm portions 77, 78 of the receptacle signal terminals 70 through 180° about a vertically extending axial line (Z-axis direction). Since the shape of the contact arm portions 87, 88 is identical to the shape of the previously discussed contact arm portions 77, 78, the components of the contact arm portions 87, 88 are assigned reference numerals obtained by adding "10" to the reference numerals of the corresponding sections in the contact arm portions 77, 78 (for example, reference numerals "87B" and "88B" are assigned to the resilient arm portions).

The signal-type contact portion 87B-1 of the long contact arm portion 87 is located vertically at the same position as the signal-type contact portion 77B-1 of the long contact arm portion 77 and the signal-type contact portion 88B-1 of the short contact arm portion 88 is located vertically at the same position as the signal-type contact portion 78B-1 of the short contact arm portion 78, with both portions protruding in the X2 direction. The signal-type contact portions 77B-1, 78B-1 are located within the receiving portion 64 of the receptacle housing 60 and can be brought into contact with the plug signal terminals 40 of the plug connector 1 under contact pressure (see FIG. 4).

The receptacle power supply terminals 90, 100 include a first receptacle power supply terminal 90 and a second receptacle power supply terminal 100, which differ in shape from each other. In the present embodiment, a pair of terminals made up of one first receptacle power supply terminal 90 and one second receptacle power supply terminal 100 is retained in place at locations on both sides of the intermediate portion 62 of the receptacle housing 60 in the terminal array direction. Specifically, the receptacle power supply terminals 90, 100 are received and retained in place in receptacle power supply terminal holding portions (not shown) formed in the above-mentioned intermediate portion 62.

As can be seen in FIG. 6, the first receptacle power supply terminal 90 is made by bending a sheet metal member in the through-thickness direction, and its terminal width dimensions (dimensions in the Y-axis direction) are larger than those of the first receptacle signal terminals 70. Said first receptacle power supply terminal 90 has a vertically extending retained portion 91; an extension portion 92, which extends upwardly from the upper end of said retained portion 91 and is then bent at a right angle and extends in the connector-width direction toward the circuit board P2 (side X2) in a rectilinear manner; a power supply-type connecting portion 93, which is bent at the end of said extension portion 92 located closer to the circuit board P2 and extends upwardly; and two contact arm portions 94 extending downwardly from the lower end of the retained portion 91. The first receptacle power supply terminal 90 is disposed such that its terminal-width direction coincides with the terminal array direction (Y-axis direction).

The retained portion 91, which is located proximate to the upper end of the receptacle housing 60, is disposed such that the through-thickness direction of said retained portion 91 coincides with the connector-width direction. On both of its lateral edges, said retained portion 91 has two press-fit projections 91A protruding from the vertically extending lateral edges on both sides thereof in the terminal-width direction (Y-axis direction). As described hereafter, said retained portions 91 are adapted to be retained in place in the first power supply terminal retaining portions because the press-fit projections 91A bite into the interior wall surface of said first signal terminal retaining portion forming part of the receptacle power supply terminal holding portion (not shown) of the receptacle housing 60.

As can be seen in FIG. 6, along the entire length thereof, the extension portion 92 is narrower than the retained portion 91 in the terminal-width direction (Y-axis direction). In said extension portion 92, the section located closer to the retained portion 91 in the longitudinal direction thereof and having a horizontal L-shaped configuration is narrower, and the section positioned closer to the power supply-type connecting portion 93 in the above-mentioned longitudinal direction and extending in a rectilinear manner is wider.

As can be seen in FIG. 3, the signal-type connecting portion 93 is located outside of the receptacle housing 60 and, when the receptacle connector 2 is disposed on the mounting face of the circuit board P2 (see FIG. 1), is in surface contact with, and solder-connected to, the corresponding power supply circuitry on said mounting face.

As can be seen in FIG. 6, the two contact arm portions 94 are made identical in shape and are arranged in the terminal array direction (Y-axis direction). Said contact arm portions 94 are bent so as to protrude toward side X2 at locations proximate to their lower ends, with the protruding sections formed as power supply-type contact portions 94A capable of being brought into contact with the plug power supply terminals 50 of the plug connector 1 under contact pressure. As can be seen in FIG. 6, the power supply-type contact portions 94A of the two contact arm portions 94 are provided at the same location in the vertical direction. In addition, as can be seen in FIG. 3, said power supply-type contact portions 94A are located above the signal-type contact portions 77B-1, 78B-1 of the first receptacle signal terminals 70 and protrude into the receptacle-side receiving portion 64 of the receptacle housing 60.

As can be seen in FIG. 6, in the connector-width direction (X-axis direction), the second receptacle signal terminal 100 is located closer to the circuit board P2 (side X2) than the retained portion 91 and the contact arm portions 94 of the first receptacle signal terminal 90 and, at the same time, in the vertical direction (Z-axis direction), below the section extending in the connector-width direction of the extension portion 92 of the first receptacle signal terminal 90.

As can be seen in FIG. 6, the second receptacle power supply terminal 100 is made by bending a sheet metal member in the through-thickness direction and its terminal width dimensions (dimensions in the Y-axis direction) are larger than those of the second receptacle signal terminal 80. Said second receptacle power supply terminal 100 has a vertically extending retained portion 101; an extension portion 102, which is bent at a right angle from the upper end of said retained portion 101 in the connector-width direction toward the circuit board P2 (side X2) and is then bent downwardly and extends in a rectilinear manner; a power supply-type connecting portion 103, which is bent at the lower end of said extension portion 102 located closer to the circuit board P2 and extends toward the circuit board P2 (side X2); and two contact arm portions 104 extending downwardly from the lower end of the retained portion 101.

The shape of the retained portion 101 and the contact arm portions 104 is a shape obtained by flipping said retained portion 91 and said contact arm portions 94 in the connector-width direction (X-axis direction) at the same vertical positions as the previously discussed retained portion 91 and contact arm portions 94 of the first receptacle power supply terminal 90. The components of said retained portion 101 and contact arm portions 104 are assigned reference numerals obtained by adding "10" to the reference numerals of the components of the retained portion 91 and the contact arm portions 94 (for example, the reference numeral "104A" is assigned to the power supply-type contact portions). As can be seen in FIG. 3, the power supply-type contact portions 104A of the contact arm portions 104 protrude into the receptacle-side receiving portion 64 of the receptacle housing 60 at locations above the signal-type contact portions 87B-1, 88B-1 of the second receptacle signal terminals 80 and at the same locations as the power supply-type contact portions 94A of the first receptacle power supply terminals 90.

As can be seen in FIG. 6, the extension portion 102 is bent in an inverted L-shaped configuration and, along the entire length thereof, is narrower than the retained portion 101 in the terminal-width direction (Y-axis direction). Said extension portion 102 has a transverse portion 102A extending in the connector-width direction (X-axis direction) and a vertical portion 102B extending in the vertical direction (Z-axis direction), with said vertical portion 102B being wider than the above-mentioned transverse portion 102A.

As can be seen in FIG. 3, the power supply-type connecting portions 103 are located outside of the receptacle housing 60 and, when the receptacle connector 2 is disposed on the mounting face of the circuit board P2 (see FIG. 1), pass through through-holes (not shown) formed in said circuit board P2 and are solder-connected to said through-holes.

Going back to the discussion of the receptacle housing 60, as can be seen in FIG. 3, the receptacle signal terminal holding portion 63 of the receptacle housing 60 has receptacle signal terminal retaining portions 63A, 63B (first signal terminal retaining portion 63A and second signal terminal retaining portion 63B), which retain in place the retained portions 71, 81 of the receptacle signal terminals 70, 80; resilient-displacement-accommodating groove portions 63C, 63D (first resilient-displacement-accommodating groove portion 63C and second resilient-displacement-accommodating groove portion 63D), which receive a portion of the contact arm portions 77, 78 of said receptacle signal terminals 70, 80; an upper holding portion 65E, which receives the top transverse portions 85A of the extension portions 85 of the second receptacle signal terminals 80 and the extension portions 75 of the first receptacle signal terminals 70; and a lateral holding portion 63F, which receives the vertical portions 85B of the extension portions 85 of the second receptacle signal terminals 80.

As can be seen in FIG. 3, the receptacle signal terminal retaining portions 63A, 63B are formed in the top half of the substantially right-hand half (section on side X1) of the intermediate portion 62 of the receptacle housing 60 in the connector-width direction (X-axis direction). Said receptacle signal terminal retaining portions 63A, 63B are formed as slit-like openings that extend and pass through in the vertical direction while widening in a direction perpendicular to the plane of the drawing in FIG. 3.

As can be seen in FIG. 8 (B), the first signal terminal retaining portion 63A of the two receptacle signal terminal retaining portions 63A, 63B, which is located closer to side X1 in FIG. 3, has its width dimensions 51 in the terminal array direction (Y-axis direction), in other words, the distance between the interior wall surfaces of the first signal terminal retaining portion 63A, adapted to be larger than the through-thickness dimensions S2 of the retained portion 71 of the first receptacle signal terminals 70. In addition, the above-mentioned width dimensions 51 of said first signal terminal retaining portion 63A are slightly larger than the distance S3 between the protruding top faces of the protrusions 72 of the first receptacle signal terminals 70 and the external major face of the tongue 73 (major face on side Y1) in the terminal array direction.

In a manner similar to the previously discussed first signal terminal retaining portion 63A, the second signal terminal retaining portion 63B of the two receptacle signal terminal retaining portions 63A, 63B, which is located closer to side X2 in FIG. 3, also has its width dimensions, in other words, the distance between the interior wall surfaces of the second signal terminal retaining portion 63B, adapted to be larger than the through-thickness dimensions of the retained portions 81 of the second receptacle signal terminals 80. In addition, the above-mentioned width dimensions are slightly larger than the distance between the protruding top faces of the protrusions 82 of the second receptacle signal terminals 80 and the external major face of the tongue 83 (major face on side Y2) in the terminal array direction.

As a result of the above-described dimensional relationship, gaps are formed in the terminal array direction between the protruding top faces of the protrusions 72, 82 and the interior wall surface of the signal terminal retaining portions 63A, 63B opposed thereto, as well as between the above-mentioned major faces of the tongues 73, 83 and the interior wall surface of the signal terminal retaining portions 63A, 63B opposed thereto. Thus, adapting the dimensions of the signal terminal retaining portions 63A, 63B to be slightly larger in the terminal array direction allows for the retained portions 71, 81, protrusions 72, 82, and tongues 73, 83 to be readily fitted within the signal terminal retaining portions 63A, 63B when the receptacle signal terminals 70, 80 are mounted to the receptacle housing 60.

As discussed before, in the present embodiment, the tongues 73, 83 and protrusions 72, 82 of the receptacle signal terminals 70, 80 are abuttable against the interior wall surfaces of the signal terminal retaining portions 63A, 63B, and, for this reason, even if there are gaps between the protruding top faces of the protrusions 72, 82 and the major faces of the tongues 73, 83 and the interior wall surfaces of the signal terminal retaining portions 63A, 63B, the retained portions 71, 81 are retained in place within said signal terminal retaining portions 63A, 63B in the standard positions practically without any inclination in the through-thickness direction (X-axis direction) thereof. As a result, all the receptacle signal terminals 70, 80 are maintained in their standard positions without any inclination, thereby ensuring an excellent state of contact with the plug signal terminals 40 and making it possible to avoid a degradation of signal transmission quality.

In addition, in the present embodiment, the protrusions 72, 82 are provided at two locations of the retained portions 71, 81 in the vertical direction. Providing the protrusions 72, 82 at multiple locations in the vertical direction in this manner allows for the retained portions 71, 81 to be maintained in the standard positions within the signal terminal retaining portions 63A, 63B in a more stable manner. In addition, the tongues 73, 83 are provided at locations situated between the mutually adjacent protrusions 72, 82 in the vertical direction. Accordingly, the protrusions 72, 82 and the retained portions 71, 81 are disposed in an alternating manner in the vertical direction, thereby allowing for the retained portions 71, 81 to be maintained in the standard positions within the signal terminal retaining portions 63A, 63B in a more reliable and stable manner.

The first resilient-displacement-accommodating groove portion 63C of the two resilient-displacement-accommodating groove portions 63C, 63D, which is located closer to side X1 in FIG. 3, extends in the vertical direction under the first signal terminal retaining portion 63A and is placed in communication with said first signal terminal retaining portion 63A. Said first resilient-displacement-accommodating groove portion 63C is formed in the shape of a groove that is recessed from the lateral face of the protruding wall 65 located closer to side X1 in the connector-width direction and extends and passes therethrough in the vertical direction, and holds the sections of the contact arm portions 77, 78 of the first receptacle signal terminals 70 located closer to side X2.

As can be seen in FIG. 3, the bottom of said first resilient-displacement-accommodating groove portion 63C extends downwardly with an inclination toward side X2 in a range that extends from the upper end of the first resilient-displacement-accommodating groove portion 63C to the intermediate location in the vertical direction, and extends downwardly without any inclination in a range that extends from said intermediate location to the lower end. Accordingly, a gap is formed between the above-mentioned bottom and the contact arm portions 77, 78 in the connector-width direction. The first resilient-displacement-accommodating groove portion 63C makes use of the above-mentioned gap to accommodate the resilient displacement of the contact arm portions 77, 78.

The second resilient-displacement-accommodating groove portion 63D of the two resilient-displacement-accommodating groove portions 63C, 63D, which is located closer to side X2 in FIG. 3, is symmetrical in shape to the previously discussed first resilient-displacement-accommodating groove portion 63C in the connector-width direction. Said second resilient-displacement-accommodating groove portion 63D holds the sections of the contact arm portions 87, 88 of the second receptacle signal terminals 80 located closer to side X1. In addition, said second resilient-displacement-accommodating groove portion 63D accommodates the resilient displacement of said contact arm portions 87, 88 using a gap formed between the contact arm portions 87, 88 and the bottom of the second resilient-displacement-accommodating groove portion 63D in the connector-width direction.

As can be seen in FIG. 3, the upper holding portion 63E is recessed from the top face of the intermediate portion 62 of the receptacle housing 60 at the locations of the receptacle signal terminals 70, 80 in the terminal array direction (Y-axis direction) and is formed in a range extending from the location of the first signal terminal retaining portion 63A to the left end of the above-mentioned intermediate portion 62 (end on side X2) in the connector-width direction (X-axis direction). Upper partitions 66, which rise upward from the top face of the intermediate portion 62 at locations on the left-hand side of the intermediate portion 62 in the connector-width direction, are formed between upper holding portions 63E adjacent in the terminal array direction. All the upper holding portions 63E formed in the intermediate portion 62 are in communication in the terminal array direction in a range that excludes the upper partitions 66 when viewed in the terminal array direction. As can be seen in FIG. 3, the top transverse portions 85A of the extension portions 85 of the second receptacle signal terminals 80 and the extension portions 75 of the first receptacle signal terminals 70 received in said upper holding portions 63E are located within the range of the upper partitions 66 in the vertical direction. As a result, the travel of the extension portions 75 and the top transverse portions 85A in the terminal array direction is restricted by the upper partitions 66.

As can be seen in FIG. 3, at the location of the receptacle terminals 70, 80 in the terminal array direction, the lateral holding portions 63F are recessed from the lateral face on side X2 of the intermediate portion 62 of the receptacle housing 60 and, in the vertical direction, are formed in a range extending from the lower end of the upper holding portion 63E to a location proximate to the lower end of the above-mentioned intermediate portion 62. Lateral partitions 67, which rise upward toward side X2 from the lateral face of the intermediate portion 62 at locations on the lower end side of the intermediate portion 62, are formed between lateral holding portions 63F adjacent in the terminal array direction. All the lateral holding portions 63F formed in the intermediate portion 62 are in communication in the terminal array direction in a range that excludes the lateral partitions 67 when viewed in the terminal array direction. As can be seen in FIG. 3, the vertical portions 85B of the extension portions 85 of the second receptacle signal terminals 80 received in said lateral holding portions 63F are located within the range of the lateral partitions 67 in the connector-width direction (X-axis direction). As a result, the travel of the vertical portions 85B in the terminal array direction is restricted by the lateral partitions 67.

The receptacle power supply terminal holding portion (not shown) of the receptacle housing 60 has receptacle power supply terminal retaining portions that retain the retained portions 91, 101 of the receptacle power supply terminals 90, 100; resilient-displacement-accommodating groove portions receiving a portion of the contact arm portions 94, 104 of said receptacle power supply terminals 90, 100; upper holding portions receiving the extension portions 92 of the first receptacle power supply terminals 90 and the transverse portions 102A of the extension portions 102 of the second receptacle power supply terminals 100; and lateral holding portions receiving the vertical portions 102B of the extension portions 102 of the second receptacle power supply terminals 100.

The above-mentioned receptacle power supply terminal retaining portion and the above-mentioned resilient-displacement-accommodating groove portion located under said receptacle power supply terminal retaining portion are recessed from the two wall surfaces of the interior wall surfaces forming the receptacle-side receiving portion 64 of the receptacle housing 60 that are opposed to both lateral faces of the protruding wall 65 in the connector-width direction (X-axis direction) (wall surfaces located on both sides of the protruding wall 65 in the connector-width direction) and are formed in a vertically extending groove-like configuration. In other words, on each of said two wall surfaces, the above-mentioned receptacle power supply terminal retaining portion and the above-mentioned resilient-displacement-accommodating groove portion constitute a single continuous groove portion extending vertically. Said groove portions located closer to side X1 in the connector-width direction have the retained portion 91 of the first receptacle power supply terminal 90 retained therein via press-fitting while receiving the contact arm portion 94 of the first receptacle power supply terminal 90 in a manner permitting resilient displacement. On the other hand, said groove portions located closer to side X2 in the connector-width direction have the retained portion 101 of the second receptacle power supply terminal 100 retained therein via press-fitting while, at the same time, holding the contact arm portion 104 of the second receptacle power supply terminal 100 in a manner permitting resilient displacement.

The shape of the above-mentioned upper holding portions and the above-mentioned lateral holding portions of the above-mentioned receptacle power supply terminal holding portion corresponds to that of the previously discussed upper holding portions 63E and lateral holding portions 63F of the receptacle signal terminal holding portion 63 and is made wider in the terminal array direction. In addition, similarly to the previously discussed receptacle signal terminals 70, 80, the travel of the extension portions 92, 102 of the receptacle power supply terminals 90, 100 received in the above-mentioned upper holding portions and the above-mentioned lateral holding portions in the terminal array direction is restricted by the partitions provided in the intermediate portion 62.

The thus-configured receptacle connector 2 is manufactured in accordance with the following procedure. First, the second receptacle signal terminals 80 are inserted into the receptacle signal terminal holding portion 63 of the receptacle housing 60 from above. As a result, the retained portions 81 of the second receptacle signal terminals 80 are press-fitted into the second signal terminal retaining portion 63B and said second receptacle signal terminals 80 are received and retained in place in the receptacle signal terminal holding portion 63.

Further, the second receptacle power supply terminals 100 are inserted into the receptacle power supply terminal holding portion (not shown) of the receptacle housing 60 from above. As a result, the retained portions 101 of the second receptacle power supply terminals 100 are press-fitted into the receptacle power supply terminal retaining portion and the second receptacle power supply terminals 100 are received and retained in place in the above-mentioned receptacle power supply terminal holding portion.

Next, the first receptacle signal terminals 70 are inserted into the receptacle signal terminal holding portion 63 of the receptacle housing 60 from above. As a result, the retained portions 71 of the first receptacle signal terminals 70 are press-fitted into the first signal terminal retaining portion 63A and said first receptacle signal terminals 70 are received and retained in place in the receptacle signal terminal holding portion 63.

Further, the first receptacle power supply terminals 90 are inserted into the receptacle power supply terminal holding portion (not shown) of the receptacle housing 60 from above. As a result, the retained portions 91 of the first receptacle power supply terminals 90 are press-fitted into the receptacle power supply terminal retaining portion and the first receptacle power supply terminals 90 are received and retained in place in the above-mentioned receptacle power supply terminal holding portion.

Mounting the receptacle terminals 70, 80, 90, 100 to the receptacle housing 60 in this manner completes the assembly of the receptacle connector 2.

The operation of mating of the plug connector 1 and receptacle connector 2 will be described next. First, the plug connector 1 is mounted to the mounting face of the circuit board P1 using solder connections while the receptacle connector 2 is mounted to the mounting face of the circuit board P2 using solder connections. Next, as can be seen in FIGS. 1 and 3, the mating portion 31 of the plug connector 1 is disposed in an upwardly facing orientation and the receptacle connector 2 is placed above the plug connector 1 in an orientation in which the receptacle-side receiving portion 64 is downwardly open. Mating with the plug connector 1 is then initiated by lowering the receptacle connector 2.

In the process of connector mating, the mating portion 31 of the plug connector 1 enters the receptacle-side receiving portion 64 of the receptacle connector 2 from below while the protruding wall 65 of the receptacle connector 2 enters the plug-side receiving portion 34 of the plug connector 1 from above. As a result, the signal-type contact portions 43 of the plug signal terminals 40 of the plug connector 1 abut the signal-type contact portions 77B-1, 78B-1 of the receptacle signal terminals 70, 80 and resiliently displace the contact arm portions 77, 78 (see FIG. 4). In addition, the signal-type contact portions 53 of the plug power supply terminals 50 of the plug connector 1 abut the power supply-type contact portions 94A, 104A of the receptacle power supply terminals 90, 100 and resiliently displace the contact arm portions 94, 104.

Furthermore, as can be seen in FIG. 4, as the process of connector mating advances and the mating portion 31 of the plug connector 1 reaches the interior of the receptacle-side receiving portion 64 of the receptacle connector 2, the protruding wall 65 of the receptacle connector 2 reaches the interior of the plug-side receiving portion 34 of the plug connector 1, thereby establishing a state of mated connection between the plug connector 1 and the receptacle connector 2 and completing the operation of connector mating. When the connectors are mated, the state of resilient displacement of the contact arm portions 77, 78 of the receptacle signal terminals 70, 80 is maintained, and the signal-type contact portions 43 of the plug signal terminals 40 are held in contact with the signal-type contact portions 77B-1, 78B-1 of the receptacle signal terminals 70, 80 under contact pressure. In addition, the state of resilient displacement of the contact arm portions 94, 104 of the receptacle power supply terminals 90, 100 is maintained and the signal-type contact portions 53 of the plug power supply terminals 50 are brought into contact with the power supply-type contact portions 94A, 104A of the receptacle power supply terminals 90, 100 under contact pressure. As a result, the plug terminals 40, 50 and the receptacle terminals 70, 80, 90, 100 are placed in electrical communication.

Immediately prior to connector mating and when the connectors are mated, the positions in which the plug connector 1 and receptacle connector 2 are mated are not necessarily the standard positions in the terminal array direction and in the connector-width direction, and there may be an offset in these directions. In the present embodiment, the offset of the connectors 1 and 2 is absorbed due to this so-called floating, in which the movable housing 30 moves in the direction of the offset as a result of resilient displacement of the resilient portions 45, 55 of the plug terminals 40, 50.

In addition, when during connector extraction the receptacle connector 2 mated with the plug connector 1 is lifted in the direction of connector extraction, in other words, upwardly (in the Z1 direction), an upwardly directed external force produced by friction against the receptacle terminals 70, 80, 90, 100 and the like acts upon the plug terminals 40, 50. As a result, the movable housing 30 of the plug connector 1 moves upwardly a predetermined amount while entailing a resilient displacement of the resilient portions 45, 55 of the plug terminals 40, 50. However, the restricted faces 36A of the restricted portions 36 of said movable housing 30 abut the restricting faces 22B-1 of the restricting portions 22B of the stationary housing 20 from below, thereby restricting travel in excess of said predetermined amount. Therefore, the stationary housing 20 and, consequently, the plug terminals 40, 50 are not lifted any further, thereby preventing the peeling of the connecting portions 41, 51 of the plug terminals 40, 50 and the detachment of the plug connector 1 from the mounting face of the circuit board P1.

However, there is a risk that the stationary housing 20 could be lifted upwardly if the force with which the restricted faces 36A of the restricted portions 36 of the movable housing 30 abut the restricting faces 22B-1 of the restricting portions 22B of the stationary housing 20 from below is too high. In the present embodiment, the retained portions 52 of the plug power supply terminals 50 have engaging portions 52B capable of engaging the engaged portions 21C of the stationary housing 20 in the vertical direction. Accordingly, even if the stationary housing 20 is lifted, the engaging faces 52B-1 of the engaging portions 52B of the plug power supply terminals 50 abut and engage the engaged faces 21C-1 of the engaged portions 21C of the stationary housing 20 from above, thereby making it possible to counteract the above-mentioned upwardly directed external force using the force of engagement. As a result, the peeling of the connecting portions 41, 51 of the plug terminals 40, 50 and, consequently, the detachment of the plug connector 1 from the mounting face of circuit board P1 can be reliably prevented.

In addition, as a result of providing the above-mentioned engaging portions 52B in the plug power supply terminals 50, there is no need to additionally provide fittings intended to counteract the external force oriented in the direction of connector extraction outside of the terminal array range, as was done in the past, and the size of the plug connector 1 in the terminal array direction is not increased.

Although in the present embodiment there are two engaging portions 52B of the plug power supply terminals 50 provided in the terminal-width direction, the number of the engaging portions is not limited thereto and, for example, there may be three or more portions. In addition, there may be one portion if a sufficient surface area can be ensured on the engaging faces.

Although in the present embodiment protrusions 72, 82 are used as the first abutment portions provided on one major side of the retained portions 71, 81 and tongues 73, 83 are used as the second abutment portions provided on the other major side in the receptacle signal terminals 70, 80, the form of the first abutment portions and second abutment portions is not limited thereto. For example, both the first abutment portions and second abutment portions may be protrusions; in addition, both the first abutment portions and second abutment portions may be tongues.

Further, although in the present embodiment there are two protrusions provided at each location in the vertical direction, the number of protrusions is not limited thereto, and there may be either one protrusion or three or more protrusions. In addition, if there is one protrusion provided at each location in the vertical direction, said protrusions may be shaped to extend in the width direction of the retained portions (X-axis direction). Shaping them in this manner makes it possible to increase the surface area of the protruding top faces of said protrusions, in other words, the surface area abuttable against the interior wall surface of the terminal retaining portions, and make the orientation of the receptacle signal terminals easier to stabilize.

Although in the present embodiment the protrusions 72, 82 are provided at two locations in the vertical direction and the tongues 73, 83 are provided at a single location in the vertical direction, the number of locations where the protrusions and tongues are provided in the vertical direction is not limited thereto and may be further increased. This makes it easier to stabilize the orientation of the receptacle signal terminals.

DESCRIPTION OF THE REFERENCE NUMERALS

1 Plug connector
2 Receptacle connector
10 Plug housing
20 Stationary housing
21C Engaged portion
22 Stationary-side end wall
30 Movable housing
40 Plug signal terminals
41 Signal-type connecting portion
42 Stationary-side retained portion
43 Signal-type contact portion
44 Movable-side retained portion
45 Signal-type resilient portion
45A Lower curved portion
45B Upper curved portion
50 Plug power supply terminals
51 Power supply-type connecting portion
52 Stationary-side retained portion
52B Engaging portions
53 Power supply-type contact portion
60 Receptacle housing
63A First signal terminal retaining portion
63B Second signal terminal retaining portion
70 First receptacle signal terminals
71 Retained portion
72 Protrusion (first abutment portion)
73 Tongue (second abutment portion)
77 Long contact arm portion
77B-1 Signal-type contact portion
78 Short contact arm portion
78B-1 Signal-type contact portion
80 Second receptacle signal terminals
81 Retained portion
82 Protrusion (first abutment portion)
73 Tongue (second abutment portion)

P1 Circuit board
P1 Circuit board

The invention claimed is:

1. An electrical connector for circuit boards provided with terminals, the electrical connector for circuit boards comprising:

a connecting portion configured to connect to a mounting face of a circuit board formed at one end of said terminals in the longitudinal direction and a contact portion configured to contact with a counterpart connector element formed at the other end thereof, and with a housing retaining said multiple terminals in place in array form, said housing having a stationary housing, which is mounted to the circuit board through the medium of the terminals, and a movable housing, which is formed as a member separate from said stationary housing, is movable relative to said stationary housing, and has the contact portions of the terminals disposed therein, wherein:

the terminals have stationary-side retained portions retained in place in the stationary housing, movable-side retained portions retained in place in the movable housing, and resilient portions provided between said stationary-side retained portions and said movable-side retained portions, and the resilient portions have curved portions curved such that they have sections positioned overlappingly in the heightwise direction of the connector perpendicular to the mounting face of the circuit board in a section of said resilient portions in the longitudinal direction;

the curved portions have at least one or more of an upper folded portion and a lower folded portion that are configured to be folded back in place in the longitudinal direction and in a connector-width direction.

2. The electrical connector for circuit boards according to claim 1, wherein the curved portions are formed at least at one end of the resilient portions in the longitudinal direction.

3. The electrical connector for circuit boards according to claim 1, wherein the resilient portions have regions where sections other than the curved portions overlap with the curved portions in the connector-width direction parallel to the mounting face of the circuit board at an angle to the heightwise direction of the connector.

4. The electrical connector for circuit boards according to claim 1, wherein the multiple terminals have signal terminals and power supply terminals, and the connecting portions of said power supply terminals are located closer to the contact portions of the signal terminals in the connector-width direction than the connecting portions of the signal terminals.

* * * * *